US007967677B2

(12) United States Patent
Baerlocher et al.

(10) Patent No.: US 7,967,677 B2
(45) Date of Patent: Jun. 28, 2011

(54) GAMING SYSTEM AND METHOD FOR PROVIDING VIRTUAL DRAWINGS

(75) Inventors: Anthony J. Baerlocher, Reno, NV (US); Bryan Bullard, Las Vegas, NV (US); Daniel Dewaal, Las Vegas, NV (US); William Little, Las Vegas, NV (US); Christopher D. Reddicks, Reno, NV (US); James A. Vasquez, Carson City, NV (US)

(73) Assignee: IGT, Reno, NV (US)

( * ) Notice: Subject to any disclaimer, the term of this patent is extended or adjusted under 35 U.S.C. 154(b) by 1267 days.

(21) Appl. No.: 11/557,854

(22) Filed: Nov. 8, 2006

(65) Prior Publication Data

US 2008/0108424 A1 May 8, 2008

(51) Int. Cl.
*A63F 3/00* (2006.01)

(52) U.S. Cl. ..... 463/25; 463/17

(58) Field of Classification Search ..... 463/25, 463/17, 16

See application file for complete search history.

(56) References Cited

U.S. PATENT DOCUMENTS

| | | | |
|---|---|---|---|
| 3,645,531 | A | 2/1972 | Wright |
| 4,283,709 | A | 8/1981 | Lucero et al. |
| 4,339,798 | A | 7/1982 | Hedges et al. |
| 4,531,187 | A | 7/1985 | Uhland |
| 4,582,324 | A | 4/1986 | Koza et al. |
| 4,636,951 | A | 1/1987 | Harlick |
| 4,652,998 | A | 3/1987 | Koza et al. |
| 4,669,731 | A | 6/1987 | Clarke |
| 4,679,143 | A | 7/1987 | Hagiwara |
| 4,695,053 | A | 9/1987 | Vazquez, Jr. et al. |
| 4,755,941 | A | 7/1988 | Bacchi |
| 4,782,468 | A | 11/1988 | Jones et al. |
| 4,817,951 | A | 4/1989 | Crouch et al. |
| 4,837,728 | A | 6/1989 | Barrie et al. |
| 4,856,787 | A | 8/1989 | Itkis |
| 4,871,171 | A | 10/1989 | Rivero |

(Continued)

FOREIGN PATENT DOCUMENTS

CA 2 453 758 7/2004

(Continued)

OTHER PUBLICATIONS

All That Glitters Advertisement (2 pages), written by WMS Gaming, printed on Mar. 8, 2007, available prior to Nov. 2006.

(Continued)

*Primary Examiner* — Peter DungBa Vo
*Assistant Examiner* — Allen Chan
(74) *Attorney, Agent, or Firm* — K&L Gates LLP

(57) ABSTRACT

A gaming system and method of providing a virtual drawing or drawing promotion including a central server, one or more location servers, and a plurality of gaming devices. A player is provided with a drawing account voucher, which is associated with a drawing account. Based on game play, the drawing account is credited with drawing entries or virtual tickets for a drawing promotion. In one embodiment, the gaming system provides a number of drawing entries when a wager placed by a player meets at least a wager threshold amount, wherein the number of drawing entries provided is based on a ticket award amount. The gaming system, upon expiration of a drawing period, selects a winner of the drawing promotion by selecting a drawing entry. In one embodiment, the gaming system progressively increases the drawing prize based on the number of drawing entries provided or wagers placed by the players.

29 Claims, 20 Drawing Sheets

U.S. PATENT DOCUMENTS

| | | | |
|---|---|---|---|
| 4,948,138 | A | 8/1990 | Pease et al. |
| 5,007,641 | A | 4/1991 | Seidman |
| 5,038,022 | A | 8/1991 | Lucero |
| 5,080,364 | A | 1/1992 | Seidman |
| 5,083,271 | A | 1/1992 | Thacher et al. |
| 5,096,195 | A | 3/1992 | Gimmon |
| 5,116,055 | A | 5/1992 | Tracy |
| 5,129,652 | A | 7/1992 | Wilkinson |
| 5,152,529 | A | 10/1992 | Okada |
| 5,186,460 | A | 2/1993 | Fongellaz et al. |
| 5,242,163 | A | 9/1993 | Fulton |
| 5,249,800 | A | 10/1993 | Hilgendorf et al. |
| 5,257,179 | A | 10/1993 | DeMar |
| 5,265,874 | A | 11/1993 | Dickinson et al. |
| 5,275,400 | A | 1/1994 | Weingardt et al. |
| 5,280,909 | A | 1/1994 | Tracy |
| 5,283,733 | A | 2/1994 | Colley |
| 5,287,269 | A | 2/1994 | Dorrough et al. |
| 5,288,081 | A | 2/1994 | Breeding |
| 5,290,033 | A | 3/1994 | Bittner et al. |
| 5,321,241 | A | 6/1994 | Craine |
| 5,326,104 | A | 7/1994 | Pease et al. |
| 5,332,076 | A | 7/1994 | Ziegret |
| 5,342,047 | A | 8/1994 | Heidel et al. |
| 5,393,057 | A | 2/1995 | Marnell, II |
| 5,393,067 | A | 2/1995 | Paulsen et al. |
| 5,397,125 | A | 3/1995 | Adams |
| 5,417,430 | A | 5/1995 | Breeding |
| 5,429,361 | A | 7/1995 | Raven et al. |
| 5,457,306 | A | 10/1995 | Lucero |
| 5,470,079 | A | 11/1995 | LeStrange et al. |
| 5,472,197 | A | 12/1995 | Gwiasda et al. |
| 5,544,892 | A | 8/1996 | Breeding |
| 5,547,202 | A | 8/1996 | Tsumura |
| 5,559,312 | A | 9/1996 | Lucero |
| 5,560,603 | A | 10/1996 | Seelig et al. |
| 5,564,700 | A | 10/1996 | Celora |
| 5,564,701 | A | 10/1996 | Dettor |
| 5,580,309 | A | 12/1996 | Piechowiak et al. |
| 5,611,730 | A | 3/1997 | Weiss |
| 5,639,088 | A | 6/1997 | Schneider et al. |
| 5,645,486 | A | 7/1997 | Nagao et al. |
| 5,655,961 | A | 8/1997 | Acres et al. |
| 5,655,966 | A | 8/1997 | Werdin, Jr. et al. |
| 5,664,998 | A | 9/1997 | Seelig et al. |
| 5,674,128 | A | 10/1997 | Holch et al. |
| 5,702,304 | A | 12/1997 | Acres et al. |
| 5,707,287 | A | 1/1998 | McCrea, Jr. |
| 5,735,525 | A | 4/1998 | McCrea, Jr. |
| 5,741,183 | A | 4/1998 | Acres et al. |
| 5,752,882 | A | 5/1998 | Acres et al. |
| 5,758,875 | A | 6/1998 | Giacalone, Jr. |
| 5,761,647 | A | 6/1998 | Boushy |
| 5,762,552 | A | 6/1998 | Vuong et al. |
| 5,766,075 | A | 6/1998 | Cook et al. |
| 5,766,076 | A | 6/1998 | Pease et al. |
| 5,769,716 | A | 6/1998 | Saffari et al. |
| 5,770,533 | A | 6/1998 | Franchi |
| 5,779,242 | A | 7/1998 | Kaufmann |
| 5,779,544 | A | 7/1998 | Seelig et al. |
| 5,779,549 | A | 7/1998 | Walker et al. |
| 5,796,716 | A | 8/1998 | Smith |
| 5,800,268 | A | 9/1998 | Molnick |
| 5,800,269 | A | 9/1998 | Holch et al. |
| 5,806,045 | A | 9/1998 | Biorge et al. |
| 5,811,772 | A | 9/1998 | Lucero |
| 5,813,912 | A | 9/1998 | Shultz |
| 5,816,918 | A | 10/1998 | Kelly et al. |
| 5,820,459 | A | 10/1998 | Acres et al. |
| 5,820,460 | A | 10/1998 | Fulton |
| 5,823,874 | A | 10/1998 | Adams |
| 5,833,536 | A | 11/1998 | Davids et al. |
| 5,833,538 | A | 11/1998 | Weiss |
| 5,836,817 | A | 11/1998 | Acres et al. |
| 5,851,148 | A | 12/1998 | Brune et al. |
| 5,851,149 | A | 12/1998 | Xidos et al. |
| D404,436 | S | 1/1999 | McGahn et al. |
| 5,855,515 | A | 1/1999 | Pease et al. |
| 5,876,284 | A | 3/1999 | Acres et al. |
| 5,877,633 | A | 3/1999 | Ng et al. |
| 5,885,158 | A | 3/1999 | Torango et al. |
| 5,902,184 | A | 5/1999 | Bennett |
| 5,902,983 | A | 5/1999 | Crevelt et al. |
| 5,911,418 | A | 6/1999 | Adams |
| 5,911,626 | A | 6/1999 | McCrea, Jr. |
| 5,919,088 | A | 7/1999 | Weiss |
| 5,919,091 | A | 7/1999 | Bell et al. |
| 5,924,927 | A | 7/1999 | Matsuura et al. |
| 5,935,000 | A | 8/1999 | Sanchez, II et al. |
| 5,935,004 | A | 8/1999 | Tarr et al. |
| 5,941,772 | A | 8/1999 | Paige |
| 5,944,608 | A | 8/1999 | Reed et al. |
| 5,947,820 | A | 9/1999 | Morro et al. |
| 5,951,397 | A | 9/1999 | Dickinson |
| 5,952,640 | A | 9/1999 | Lucero |
| 5,959,277 | A | 9/1999 | Lucero |
| 5,967,896 | A | 10/1999 | Jorasch et al. |
| 5,976,015 | A | 11/1999 | Seelig et al. |
| 5,980,384 | A | 11/1999 | Barrie |
| 5,991,736 | A | 11/1999 | Ferguson et al. |
| 5,993,316 | A | 11/1999 | Coyle et al. |
| 5,997,400 | A | 12/1999 | Seelig et al. |
| 6,001,016 | A | 12/1999 | Walker et al. |
| 6,012,982 | A | 1/2000 | Piechowiak et al. |
| 6,012,983 | A | 1/2000 | Walker et al. |
| 6,012,984 | A | 1/2000 | Roseman |
| 6,019,283 | A | 2/2000 | Lucero |
| 6,019,374 | A | 2/2000 | Breeding |
| 6,039,648 | A | 3/2000 | Guinn et al. |
| 6,048,269 | A | 4/2000 | Burns et al. |
| 6,068,552 | A | 5/2000 | Walker et al. |
| 6,071,190 | A | 6/2000 | Weiss et al. |
| 6,077,162 | A | 6/2000 | Weiss |
| 6,080,062 | A | 6/2000 | Olson |
| 6,082,887 | A | 7/2000 | Feuer et al. |
| 6,089,975 | A | 7/2000 | Dunn |
| 6,089,976 | A | 7/2000 | Schneider et al. |
| 6,089,978 | A | 7/2000 | Adams |
| 6,089,982 | A | 7/2000 | Holch et al. |
| 6,093,103 | A | 7/2000 | McCrea, Jr. |
| 6,102,400 | A | 8/2000 | Scott et al. |
| 6,110,043 | A | 8/2000 | Olsen |
| 6,110,044 | A | 8/2000 | Stern |
| 6,113,098 | A | 9/2000 | Adams |
| 6,117,011 | A | 9/2000 | Lvov |
| 6,117,012 | A | 9/2000 | McCrea, Jr. |
| 6,120,378 | A | 9/2000 | Moody et al. |
| 6,126,546 | A | 10/2000 | Reed et al. |
| 6,128,550 | A | 10/2000 | Heidel et al. |
| 6,135,885 | A | 10/2000 | Lermusiaux |
| 6,146,273 | A | 11/2000 | Olsen |
| 6,159,095 | A | 12/2000 | Frohm et al. |
| 6,159,097 | A | 12/2000 | Gura |
| 6,162,122 | A | 12/2000 | Acres et al. |
| 6,165,070 | A | 12/2000 | Nolte et al. |
| 6,165,071 | A | 12/2000 | Weiss |
| 6,165,072 | A | 12/2000 | Davis et al. |
| 6,168,521 | B1 | 1/2001 | Luciano et al. |
| 6,177,011 | B1 | 1/2001 | Lvov |
| 6,183,362 | B1 | 2/2001 | Boushy |
| 6,183,366 | B1 | 2/2001 | Goldberg et al. |
| 6,186,893 | B1 | 2/2001 | Walker et al. |
| 6,190,255 | B1 | 2/2001 | Thomas et al. |
| 6,203,010 | B1 | 3/2001 | Jorasch et al. |
| 6,206,782 | B1 | 3/2001 | Walker et al. |
| 6,210,275 | B1 | 4/2001 | Olsen |
| 6,210,276 | B1 | 4/2001 | Mullins |
| 6,210,277 | B1 | 4/2001 | Stefan |
| 6,224,482 | B1 | 5/2001 | Bennett |
| 6,224,484 | B1 | 5/2001 | Okuda et al. |
| 6,224,486 | B1 | 5/2001 | Walker et al. |
| 6,231,445 | B1 | 5/2001 | Acres |
| 6,238,287 | B1 | 5/2001 | Komori et al. |
| 6,257,981 | B1 | 7/2001 | Acres et al. |
| 6,287,202 | B1 | 9/2001 | Pascal et al. |
| 6,292,786 | B1 | 9/2001 | Deaton et al. |
| 6,309,299 | B1 | 10/2001 | Weiss |

| | | | | |
|---|---|---|---|---|
| 6,309,307 | B1 | 10/2001 | Krause et al. | |
| 6,364,765 | B1 | 4/2002 | Walker et al. | |
| 6,371,852 | B1 | 4/2002 | Acres | |
| 6,375,567 | B1 | 4/2002 | Acres | |
| 6,425,828 | B2 | 7/2002 | Walker et al. | |
| 6,454,649 | B1 | 9/2002 | Mattice et al. | |
| RE37,885 | E | 10/2002 | Acres et al. | |
| 6,508,709 | B1 | 1/2003 | Karmarkar | |
| 6,511,377 | B1 | 1/2003 | Weiss | |
| 6,514,145 | B1 | 2/2003 | Kawabata et al. | |
| 6,527,175 | B1 | 3/2003 | Dietz et al. | |
| 6,569,013 | B1 | 5/2003 | Taylor | |
| 6,575,832 | B1 | 6/2003 | Manfredi et al. | |
| 6,582,310 | B1 | 6/2003 | Walker et al. | |
| 6,597,197 | B1 | 7/2003 | Mosley et al. | |
| 6,663,487 | B1 | 12/2003 | Ladner | |
| 6,676,510 | B1 | 1/2004 | Bittman et al. | |
| 6,685,563 | B1 | 2/2004 | Meekins et al. | |
| 6,712,696 | B2 | 3/2004 | Soltys et al. | |
| 6,719,632 | B2 | 4/2004 | Palmer et al. | |
| 6,764,398 | B2 | 7/2004 | Stone et al. | |
| 6,780,111 | B2 | 8/2004 | Cannon et al. | |
| 6,786,824 | B2 | 9/2004 | Cannon | |
| 6,798,359 | B1 | 9/2004 | Ivancic | |
| 6,811,486 | B1 | 11/2004 | Luciano, Jr. | |
| 6,855,054 | B2 | 2/2005 | White et al. | |
| 6,878,063 | B2 | 4/2005 | Manfredi et al. | |
| 6,910,962 | B2 | 6/2005 | Marks et al. | |
| 7,018,292 | B2 | 3/2006 | Tracy et al. | |
| 7,071,845 | B2 | 7/2006 | Ivancic | |
| 7,137,889 | B1 | 11/2006 | Luciano, Jr. | |
| 7,169,041 | B2 | 1/2007 | Tessmer et al. | |
| 2002/0010014 | A1 | 1/2002 | Parra et al. | |
| 2002/0013169 | A1 | 1/2002 | NewDelman | |
| 2002/0039923 | A1 | 4/2002 | Cannon et al. | |
| 2002/0077168 | A1 | 6/2002 | Jones et al. | |
| 2002/0142825 | A1 | 10/2002 | Lark et al. | |
| 2002/0142846 | A1 | 10/2002 | Paulsen | |
| 2002/0151357 | A1 | 10/2002 | Acres | |
| 2002/0155887 | A1 | 10/2002 | Criss-Puszkiewicz | |
| 2002/0165023 | A1 | 11/2002 | Brosnan et al. | |
| 2002/0173354 | A1 | 11/2002 | Winans et al. | |
| 2002/0177479 | A1 | 11/2002 | Walker et al. | |
| 2003/0028480 | A1 | 2/2003 | Rowe | |
| 2003/0054868 | A1 | 3/2003 | Paulsen et al. | |
| 2003/0054881 | A1 | 3/2003 | Hedrick et al. | |
| 2003/0060264 | A1 | 3/2003 | Chilton et al. | |
| 2003/0064795 | A1 | 4/2003 | Baerlocher et al. | |
| 2003/0083943 | A1* | 5/2003 | Adams et al. | 705/14 |
| 2003/0087691 | A1 | 5/2003 | Kiely et al. | |
| 2003/0104853 | A1 | 6/2003 | Tessmer et al. | |
| 2003/0114219 | A1 | 6/2003 | McClintic | |
| 2003/0127793 | A1 | 7/2003 | Adams | |
| 2003/0149619 | A1 | 8/2003 | Stanley et al. | |
| 2003/0157979 | A1* | 8/2003 | Cannon et al. | 463/16 |
| 2003/0186734 | A1 | 10/2003 | LeMay et al. | |
| 2003/0191809 | A1 | 10/2003 | Mosley et al. | |
| 2004/0048650 | A1 | 3/2004 | Mierau et al. | |
| 2004/0235554 | A1 | 11/2004 | DeFrees-Parrott et al. | |
| 2005/0003887 | A1* | 1/2005 | Seelig | 463/25 |
| 2005/0020352 | A1 | 1/2005 | Chilton et al. | |
| 2005/0037837 | A1 | 2/2005 | Rowe | |
| 2005/0037841 | A1 | 2/2005 | De Waal et al. | |
| 2005/0049036 | A1 | 3/2005 | Mead | |
| 2005/0049042 | A1 | 3/2005 | Walker et al. | |
| 2005/0054413 | A1 | 3/2005 | Randall et al. | |
| 2005/0059458 | A1 | 3/2005 | Griswold et al. | |
| 2005/0059480 | A1 | 3/2005 | Soukup et al. | |
| 2005/0113163 | A1 | 5/2005 | Mattice et al. | |
| 2005/0119047 | A1 | 6/2005 | Olive | |
| 2005/0239542 | A1 | 10/2005 | Olsen | |
| 2006/0035696 | A1 | 2/2006 | Walker et al. | |
| 2006/0046830 | A1 | 3/2006 | Webb | |
| 2006/0089195 | A1* | 4/2006 | Walker et al. | 463/25 |
| 2006/0135253 | A1 | 6/2006 | George et al. | |
| 2006/0135262 | A1* | 6/2006 | Kennedy et al. | 463/42 |
| 2006/0178194 | A1* | 8/2006 | Jubinville et al. | 463/17 |
| 2006/0194631 | A1 | 8/2006 | Rowe et al. | |
| 2006/0252501 | A1 | 11/2006 | Little et al. | |
| 2006/0287045 | A1 | 12/2006 | Walker et al. | |
| 2007/0004505 | A1 | 1/2007 | Walker et al. | |
| 2007/0077989 | A1 | 4/2007 | Bozeman | |

FOREIGN PATENT DOCUMENTS

| | | |
|---|---|---|
| NZ | 335710 | 5/1999 |
| NZ | 501706 | 11/2000 |
| WO | WO 95/30971 | 11/1995 |
| WO | WO 98/00210 | 2/1998 |
| WO | WO 00/04472 | 1/2000 |
| WO | WO 00/20082 | 4/2000 |
| WO | WO 01/33442 | 5/2001 |
| WO | WO 01/33478 | 5/2001 |
| WO | WO 01/58546 | 8/2001 |
| WO | WO 01/83062 | 11/2001 |
| WO | WO 02/096528 | 12/2002 |
| WO | WO 2004/038551 | 5/2004 |
| WO | WO 2004/111954 | 12/2004 |
| WO | WO 2004/114067 | 12/2004 |

OTHER PUBLICATIONS

EZ-Pay Ticket System Brochures, written by IGT, available prior to 2006.

Instant Slotto Article, written by Strictly Slots, published in Apr. 2001.

Kaboom Advertisement (2 pages), written by WMS Gaming, printed on Mar. 8, 2007, available prior to Nov. 2006.

Raining Diamonds Advertisement, written by Sierra Design Group, published in 2001.

Scarne, Scarne's New Complete Guide to Gambling, 1974, Simon & Schuster, 162-167.

Silver Strike Advertisement and Pictures, written by Anchor Gaming, published in 1997.

Take Your Pick Article, written by Strictly Slots, published in Mar. 2001.

* cited by examiner

FIG. 5

200

| Wager Treshold Amount | No. Wager | Ticket Award Amount |
|---|---|---|
| 50 | 1 - 3 | 10 |
| 50 | 4 - 10 | 5 |
| 50 | 11 - 15 | 2 |
| 50 | 16+ | 1 |

FIG. 6

300

| No. of Wager Threshold Amounts Met | Ticket Award Amount |
|---|---|
| 1 | 1 |
| 2 | 2 |
| 3 | 3 |
| 4 - 10 | 5 |
| 11 - 19 | 15 |
| 20+ | 25 |

FIG. 7A

400

| Player Level | Wager Threshold Amount |
|---|---|
| Uncarded | 100 |
| Silver | 75 |
| Gold | 50 |
| Platinum | 35 |

FIG. 7B

402

| Player Level | Ticket Award Amount |
|---|---|
| Uncarded | 1 |
| Silver | 2 |
| Gold | 5 |
| Platinum | 7 |

GAMING SYSTEM AND METHOD FOR PROVIDING VIRTUAL DRAWINGS

COPYRIGHT NOTICE

A portion of the disclosure of this patent document contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Symbols or symbol combinations which are less likely to occur usually provide higher awards.

In such known gaming machines, the amount of the wager made on the base game by the player may vary. For instance, the gaming machine may enable the player to wager a minimum number of credits, such as one credit (e.g., one penny, nickel, dime, quarter or dollar) up to a maximum number of credits, such as five credits. This wager may be made by the player a single time or multiple times in a single play of the primary game. For instance, a slot game may have one or more paylines and the slot game may enable the player to make a wager on each payline in a single play of the primary game. Thus, it is known that a gaming machine, such as a slot game, may enable players to make wagers of substantially different amounts on each play of the primary or base game ranging, for example, from 1 credit up to 125 credits (e.g., 5 credits on each of 25 separate paylines). This is also true for other wagering games, such as video draw poker, where players can wager one or more credits on each hand and where multiple hands can be played simultaneously. Accordingly, it should be appreciated that different players play at substantially different wagering amounts or levels and at substantially different rates of play.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. Part of the enjoyment and excitement of playing certain gaming machines is the occurrence or triggering of the secondary or bonus game (even before the player knows how much the bonus award will be). In other words, obtaining a bonus event and a bonus award in the bonus event is part of the enjoyment and excitement for players.

Progressive awards associated with gaming machines are also known. In one form, a progressive award is an award amount which includes an initial amount funded by a casino and an additional amount funded through a portion of each wager made on the progressive gaming machine. For example, 0.1% of each wager placed on the primary game of the gaming machine associated with the progressive award may be allocated to the progressive award or progressive award fund or pool. The progressive award grows in value as more players play the gaming machines and more portions of these players' wagers are allocated to the progressive award. When a player obtains a winning symbol or symbol combination associated with the progressive award, the accumulated progressive award is provided to the player. After the progressive award is provided to the player, the amount of the next progressive award is reset to the initial value and a portion of each subsequent wager on a gaming machine associated with a progressive award is allocated to the next progressive award.

Casino loyalty programs are well known. A casino loyalty program works in conjunction with a player tracking system to offer incentives to players based on the player's play history at the gaming establishment. Loyalty programs typically have various player status levels for a player to reach, such as silver, gold, and platinum, which enable the player to receive additional prizes and/or benefits. One known way to provide loyalty incentives to players is by holding drawing promotions. That is, the gaming establishment offers the player a ticket to enter a drawing for a prize, such as a car or money. However, overhead, ticket printing, and management associated with such drawings can be relatively expensive. Accordingly, gaming establishments are in need of new and exciting ways to provide awards and prizes to loyal players as part of their gaming experience.

As discussed above, one known type of promotion is a drawing promotion. In this type of promotion the casino has a set prize (such as a TV, a cash prize, or a car) offered as part of the drawing. The drawing is set to occur at a specific date or time and players earn tickets to the drawing. One current method of orchestrating a drawing entails providing players with physical drawing tickets that they fill out with their information (such as name, address, or phone number). Once the player fills out the tickets, they place them at a specified location, such as in a drawing drum. Entry into the drawing is set to close at a specified time and, at that time, no more tickets will be accepted. Usually, shortly after the specified time, the drawing occurs wherein a gaming establishment employee selects one of the tickets from the drum and the winner is notified in an appropriate manner.

However, there are certain drawbacks associated with the above method. Players might not bother to participate in the drawing if they do not find the prize exciting or worth the effort. Players might feel that the effort required to enter the drawing, by filling out each ticket entry, is too time-consuming with not enough of a reward on or chance of winning the reward for their time investment. Players might also be confused and frustrated with the entry process if they don't know all of the rules, where to go, or how to register. Additionally there is certain overhead costs in managing drawing promotion. The casino has to purchase the tickets, "entry drum," and provide employees to manage and secure the drawing. There are also security concerns associated with an employee being in charge of the drawing. With the drum, it is possible that entries could be manipulated, the drum could be broken into, or other security breaches may occur.

Additionally, there is a continuing need to provide new and different gaming machines and gaming systems as well as new and different ways to provide awards to players based on their game play.

SUMMARY

The present disclosure provides a virtual ticketing gaming system and method for an automated drawing promotion. The gaming system and method disclosed herein provides a virtual drawing based on one or more players' play at one or more gaming devices connected to or in communication with a server or controller that maintains the drawing promotion. In one embodiment, players may participate in a drawing promotion at multiple remote gaming locations that include a location server or controller that is connected to or in communication with a central server. In one embodiment, each player participates in the drawing by inserting a drawing account voucher into a gaming device to register or submit their game play for virtual ticket accrual. That is, the gaming system registers players through a drawing account voucher associated with a drawing account into an electronic drawing for prizes, and, based on their game play, provides the player with one or more drawing entries in the form of virtual tickets credited to their drawing account.

In one example embodiment, the player is provided with a drawing account voucher through a delivery mechanism, such as at the gaming device. In other example embodiments, the player is provided with a drawing account voucher through any other suitable mechanism, such as at a kiosk in the gaming location, over the Internet, or through the postal mail. In one embodiment, the player submits the drawing account voucher to activate game play for drawing entry accrual at a gaming device or table game.

In one embodiment, the player initiates game play of the gaming device by placing a wager. In one embodiment, if the wager meets or exceeds a wager threshold amount, the gaming system provides the player with one or more drawing entries in the form of virtual tickets credited to their drawing account. In an alternative embodiment, a virtual ticket distribution event must occur for the player to receive a virtual ticket. This event can include any suitable event. In one embodiment, the drawing promotion continues until the expiration of a drawing time period. During this time, players continue to accumulate drawing entries based on their game play. In other alternative embodiments, the players can accumulate drawing entries based on other events.

In one embodiment, upon expiration of a drawing time period, the gaming system determines a winner of the drawing prize by selecting a drawing entry from one of the drawing accounts. In one embodiment, the gaming system causes the player associated with the winning drawing entry to be provided with the drawing prize. In one such embodiment, the gaming system provides the player with the drawing prize when the player inserts their drawing account voucher into the gaming device.

In one embodiment, the gaming system includes multiple remote gaming locations, each gaming location including a location server or controller connected to a database for maintaining one or more drawing promotions. In one embodiment, each location controller is connected to the central controller, enabling players at multiple locations to participate in the same drawing promotion. In one embodiment, the central controller is connected to a drawing promotion database and is programmed to maintain the drawing promotion. In another embodiment, the drawing promotion is unique to the gaming location. In another embodiment, the location controller is connected to a drawing promotion database and is programmed to maintain the drawing promotion.

In one embodiment, the gaming system includes at least one progressive drawing prize to be provided to a player. That is, the drawing prize increases as the number of tickets earned by players increases. In one embodiment, the drawing prize is a dynamic prize that changes based on the amount of tickets issued. In this embodiment, the prize amount for the drawing starts at a base amount and increments based on the number of virtual tickets issued to all players in the gaming system. In one embodiment, the gaming system tracks the number of tickets issued and compares the number to a set number. If the set number is met, the progressive drawing prize is incremented by a predetermined amount. In another embodiment, the progressive drawing prize increments a small percentage for every ticket issued. In one embodiment, the progressive drawing prize increases by rolling the prize amount over to the next drawing whenever a winning ticket is not claimed. In another embodiment, the progressive drawing prize increases based on the amount of player wagers at one or more gaming locations. Thus, the gaming system disclosed herein increases player excitement as the drawing prize amount progressively increases based on game play at the gaming devices.

In one embodiment, the drawing entries, or virtual tickets, are accumulated during game play at a gaming device in the gaming system based on player's wagers. In one embodiment, the drawing entries are provided when a player wagers at or above a wager threshold amount. In one embodiment, the controller provides a number of virtual tickets, or drawing entries, equal to a ticket award amount. In one embodiment, the wager threshold amount is based on a percentage of the player's wagers. In one embodiment, the ticket award amount is based on a percentage of the player's wagers. In one embodiment, by adjusting the wager threshold amount or ticket award amount, the gaming system provides a larger number of virtual tickets to loyal players, to players with more frequent game play, or to players that wager larger amounts. This creates more excitement for the player as the chance of winning a drawing prize is substantially increased with additional game play.

In one embodiment, a single wager must be equal to or exceed the wager threshold amount to earn virtual tickets. In another embodiment, the amount wagered over multiple wagers is accumulated to meet the wager threshold amount. In one embodiment, the gaming system awards a different number of tickets based on the number of wagers required to meet or exceed the wager threshold amount.

In one embodiment, the wager threshold amount is a set value, such as 100 credits. That is, for every 100 credits wagered the player receives one or more drawing entries. In another embodiment, the wager threshold amount changes based on game play. For example, the initial threshold amount can be 200 credits to earn 1 virtual drawing ticket. After the player meets the initial wager threshold amount, the threshold amount lowers to 100 credits for the next virtual drawing ticket, then 50 credits for the next virtual drawing ticket, etc. In another embodiment, the gaming system is configured to have progressively lower wager threshold amount levels. In an embodiment, the gaming system awards a plurality of virtual tickets equal to the ticket award amount when the player wagers at least the wager threshold amount. In one such embodiment, the player receives a progressively larger number of virtual tickets for every wager threshold amount wagered.

In one embodiment, the gaming system adjusts the wager threshold amount or the ticket award amount based on the level of game play in the gaming establishment. In another embodiment, the gaming system adjusts the wager threshold amount or the ticket award amount at different times of the day or week, such as during periods of slow game play in the casino (e.g., mornings or mid-week). In one embodiment, drawing entries are only provided to drawing accounts at specific times of the day, such as during periods of slow game play in the casino.

In another embodiment, the wager threshold amount or ticket award amount is based on the player's status in a player tracking system, such as a casino loyalty program. In another embodiment, the drawing promotion is restricted based on the player's status in a casino loyalty program. That is, certain drawing promotions may only be available for players who have achieved a suitable status in a casino loyalty program. (e.g., gold players).

In one embodiment, the player receives a progressively larger number of tickets for every wager threshold amount met during a predetermined time-period. In another embodiment, the wager threshold amount progressively decreases for each wager of the wager threshold amount during a predetermined time-period.

In one embodiment, the gaming system awards virtual tickets or drawing entries when the player wins a prize during the primary game. In another embodiment, the gaming system awards virtual tickets when the player wins a prize during a bonus or secondary game.

As discussed above, in one embodiment, the drawing account voucher is associated with a player's drawing account. In another embodiment, the drawing account voucher is associated with a drawing account that is not associated with a player. In this embodiment, the player receives a drawing account voucher and accumulates drawing entries, but the gaming establishment does not know the identity of the player until the player claims a drawing promotion prize.

In one embodiment, the drawing account is not associated with a particular drawing promotion. In this embodiment, the player accumulates drawing entries in the drawing account and can select a drawing promotion to apply one or more drawing entries to. In one embodiment, the gaming system provides a player interface for the player to review the available drawing promotions and their available drawing entries, and then apply one or more drawing entries to a selected drawing promotion. In one embodiment, the player interface is a website on the Internet. In other embodiments, the player interface is the gaming device or a kiosk. In one embodiment, the drawing entries expire and must be applied or used within a predetermined time period. In another embodiment, the drawing entries do not expire. In one embodiment, the gaming system limits the number of drawing entries a player may accumulate or apply to a particular drawing promotion.

In one embodiment, the player receives a drawing account voucher at a gaming device connected to the gaming system before the player begins game play. In another embodiment, the player receives a drawing account voucher at a customer service counter or kiosk in the gaming establishment or through the postal mail in response to a request over the telephone or Internet. In one embodiment, the drawing account voucher is a paper ticket. In one such embodiment, the paper ticket contains a bar code that is read by a bar code reader in the gaming device to identify the drawing account voucher. In another embodiment, the drawing account voucher is a voucher card with either a bar code or magnetic stripe, or one that uses radio frequency ("RF") signals.

In one embodiment, the gaming system includes a display for providing drawing information to players. In one embodiment, the display is a central display located at the casino or gaming location. The central display can be any suitable device, such as television monitors or electronic message boards provided throughout the gaming location. In one embodiment, the information displayed to the players includes general drawing promotion information, such as the drawing promotion prize, drawing period, number of drawing entries, or a virtual ticket number associated with a winning drawing entry. In one embodiment, the virtual ticket number associated with a winning drawing entry is flashed on the display or announced through an audio speaker system in the gaming location. In another embodiment, the display is located on the gaming device or provided on a kiosk or customer service station. In another embodiment, the gaming system provides the information over the Internet. In one embodiment, the information provided also includes information pertaining to the drawing account associated with the drawing account voucher, such as a list of the virtual ticket numbers associated with each drawing entry accumulated by the player, the player's odds of winning the drawing promotion, or information regarding past drawing promotions and drawing entries associated with the drawing account.

In one embodiment, virtual drawing ticket accrual, as described above, stops at session end or cash out. In an embodiment, each time a player inserts more tender, they are prompted whether they wish to participate in the drawing. In another embodiment, the player is automatically awarded virtual tickets based on wagering as long as the gaming device has the drawing account voucher inserted into it.

In one embodiment, once a drawing period expires, gaming system selects one or more drawing entries from pool of drawing entries to determine the winner of the drawing prizes. In one embodiment, the gaming system alerts the winners of the drawing prizes. In one embodiment, if the player inserts an existing drawing account voucher that contains the winning ticket, the gaming device enters celebration mode to advertise the win and arrange (or issue) the payout. In another embodiment, the gaming system alerts the player in some other manner, such as by kiosk, website, phone call or mailer. In another embodiment, the gaming system provides the ability for the players to check if they won at a kiosk or customer service location in the gaming location, or over the Internet.

It is therefore an advantage of the present disclosure to provide a virtual gaming system and method for issuing drawing account vouchers and virtual drawing tickets to players.

It is a further advantage of the present disclosure to increase player excitement and decrease player fatigue by allowing for a dynamic prize to be associated with the drawing promotion based on game play to ensure the prize is inline with player expectations associated with the odds of winning the drawing promotion.

It is a further advantage of the present disclosure to automate a drawing promotion. This eliminates the need for physical drawing tickets and a manual drawing, eliminating player confusion, overhead cost, and security issues.

Additional features and advantages are described herein, and will be apparent from, the following Detailed Description and the figures.

BRIEF DESCRIPTION OF THE FIGURES

FIG. 5 is a table representing an embodiment of the gaming system of the present disclosure.

FIG. 6 is a table representing an embodiment of the gaming system of the present disclosure.

FIG. 7A is a table representing an embodiment of the gaming system of the present disclosure.

FIG. 7B is a table representing an embodiment of the gaming system of the present disclosure.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by a central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
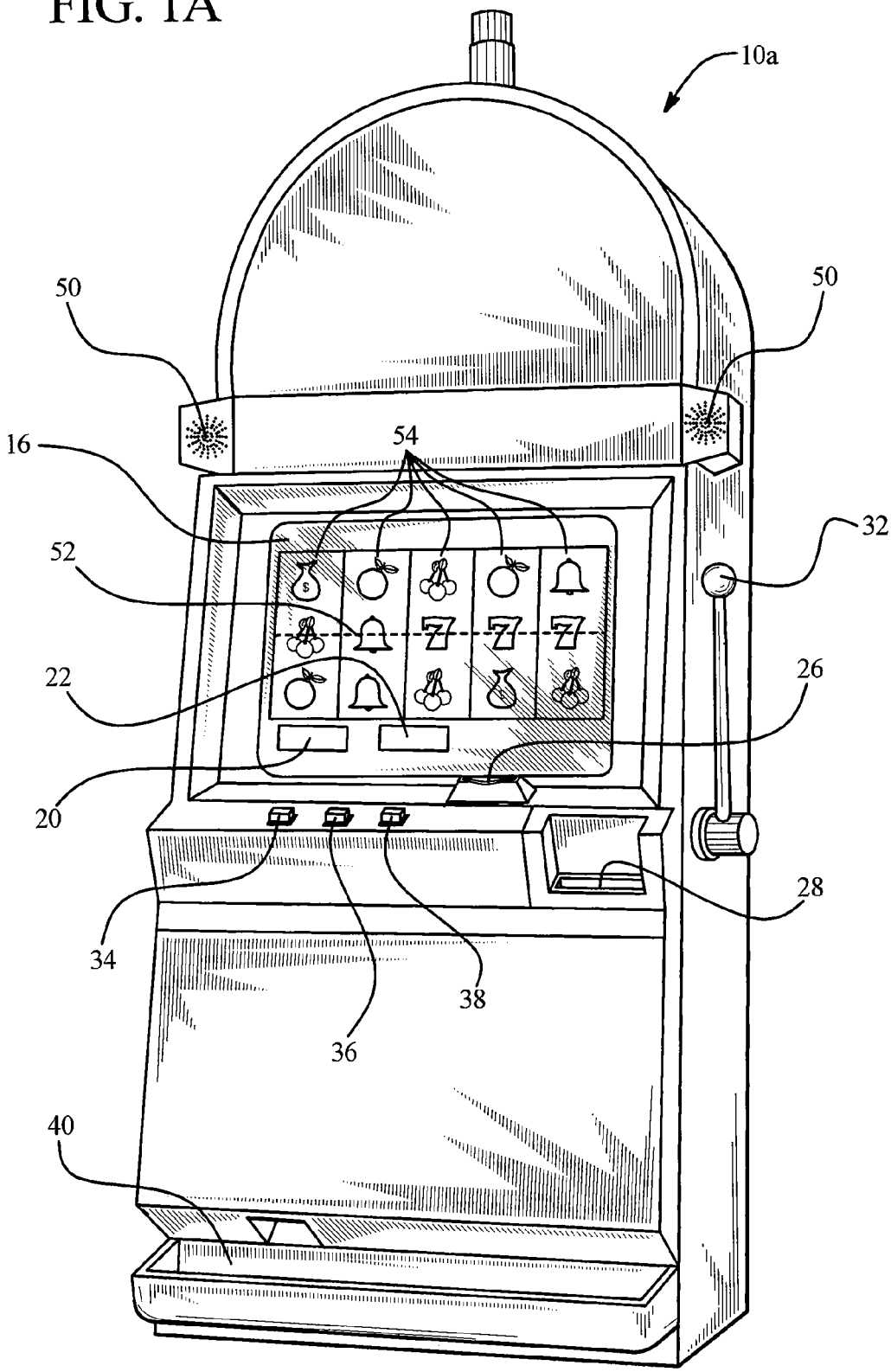
FIG. 1A is a front perspective view of one embodiment of the gaming device of the present disclosure.
Figure 1B:
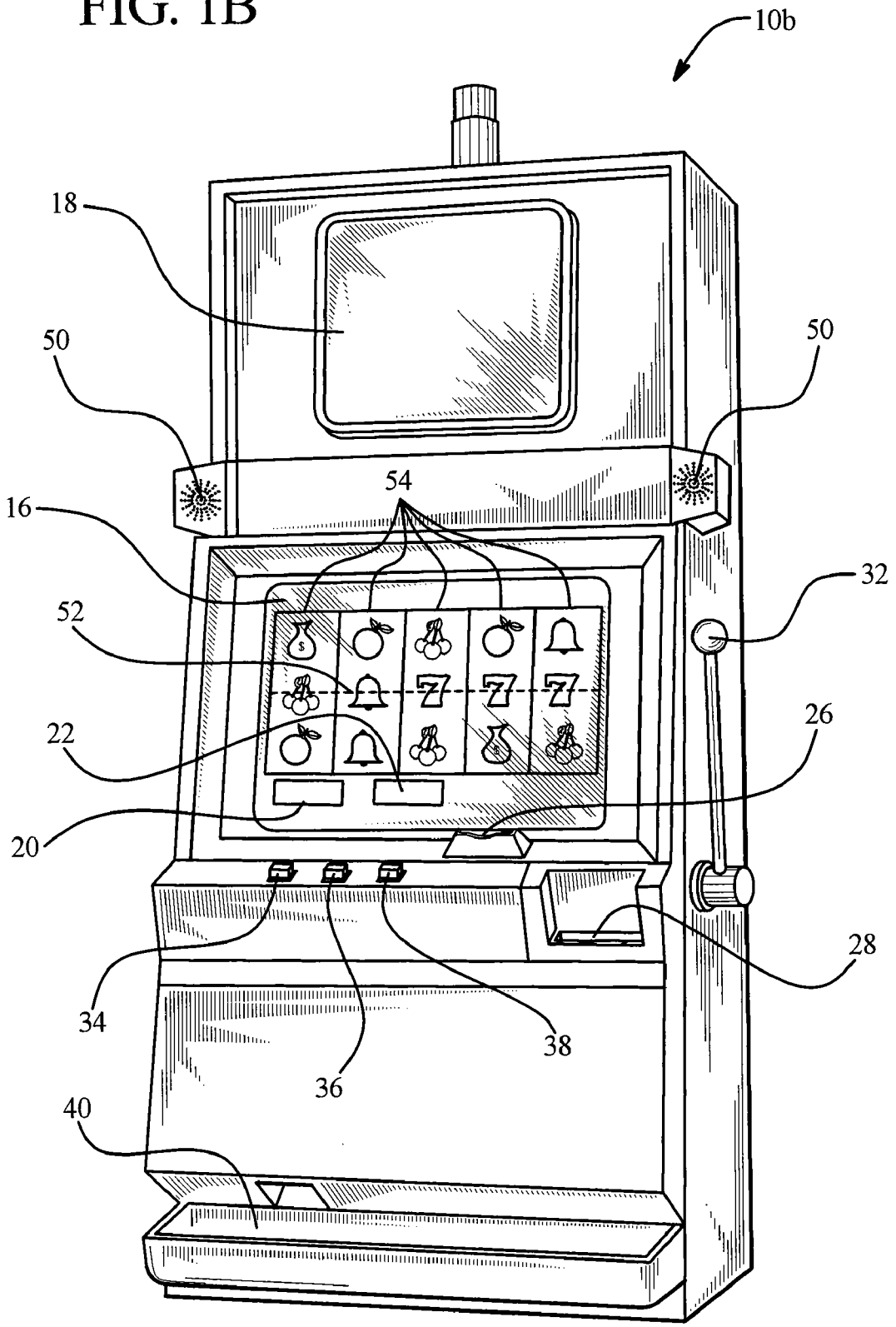
FIG. 1B is a front perspective view of another embodiment of the gaming device of the present disclosure.

Referring now to the drawings, two example alternative embodiments of the gaming device of the disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
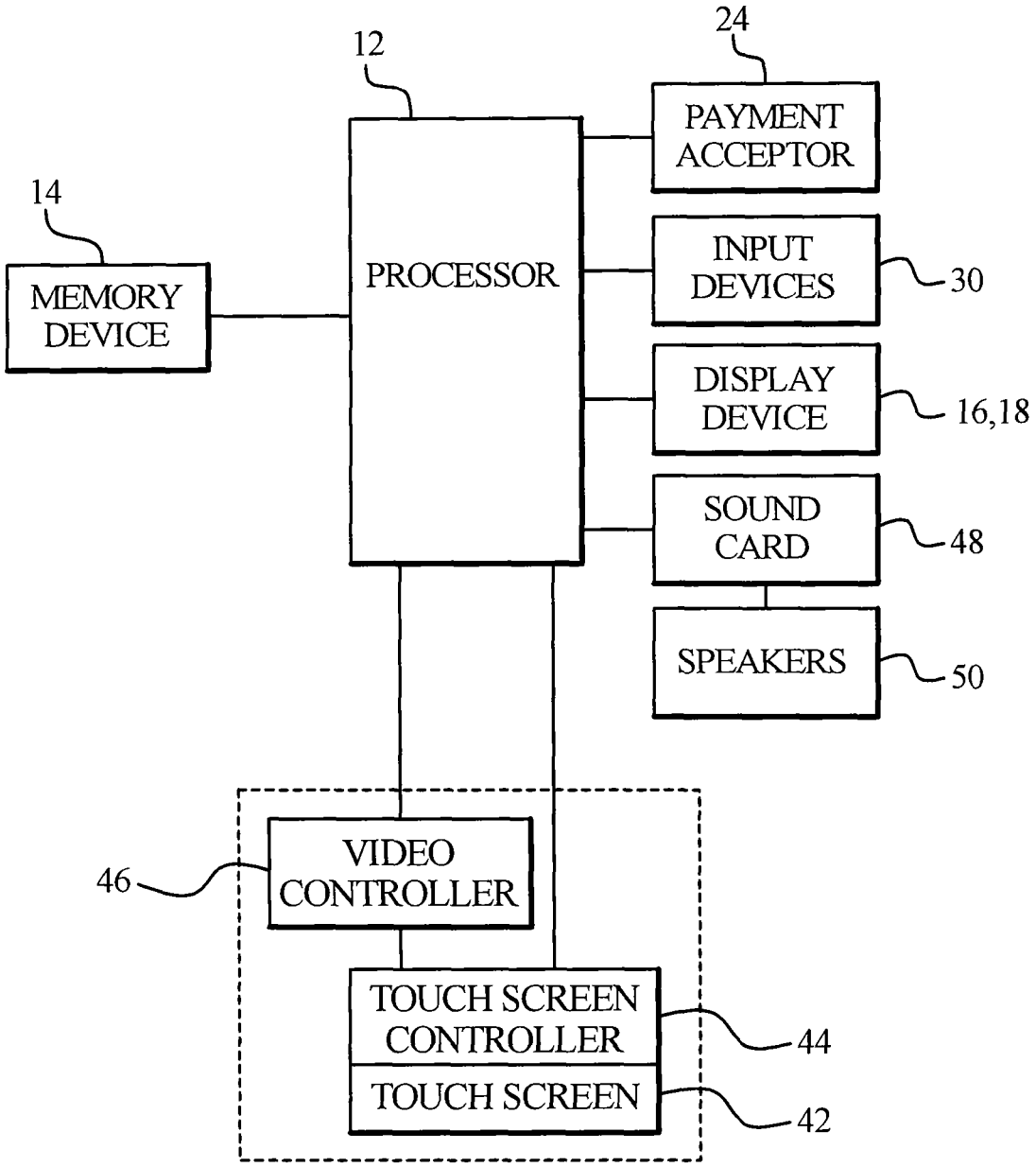
FIG. 2A is a schematic block diagram of one embodiment of an electronic configuration for one of the gaming devices of the present disclosure.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, gaming device includes a bet display 22 which displays a player's amount wagered.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, gaming device 10 includes at least one payment acceptor 24 in communication with the processor. As seen in FIGS. 1A and 1B, payment acceptor 24 may include a coin slot 26 and a payment, note or bill acceptor 28, in which the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of gaming device 10. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to gaming device 10. In one embodiment, money may be transferred to a gaming device through electronic funds transfer. When a player funds the gaming device, processor 12 determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier (or other suitable redemption system) or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
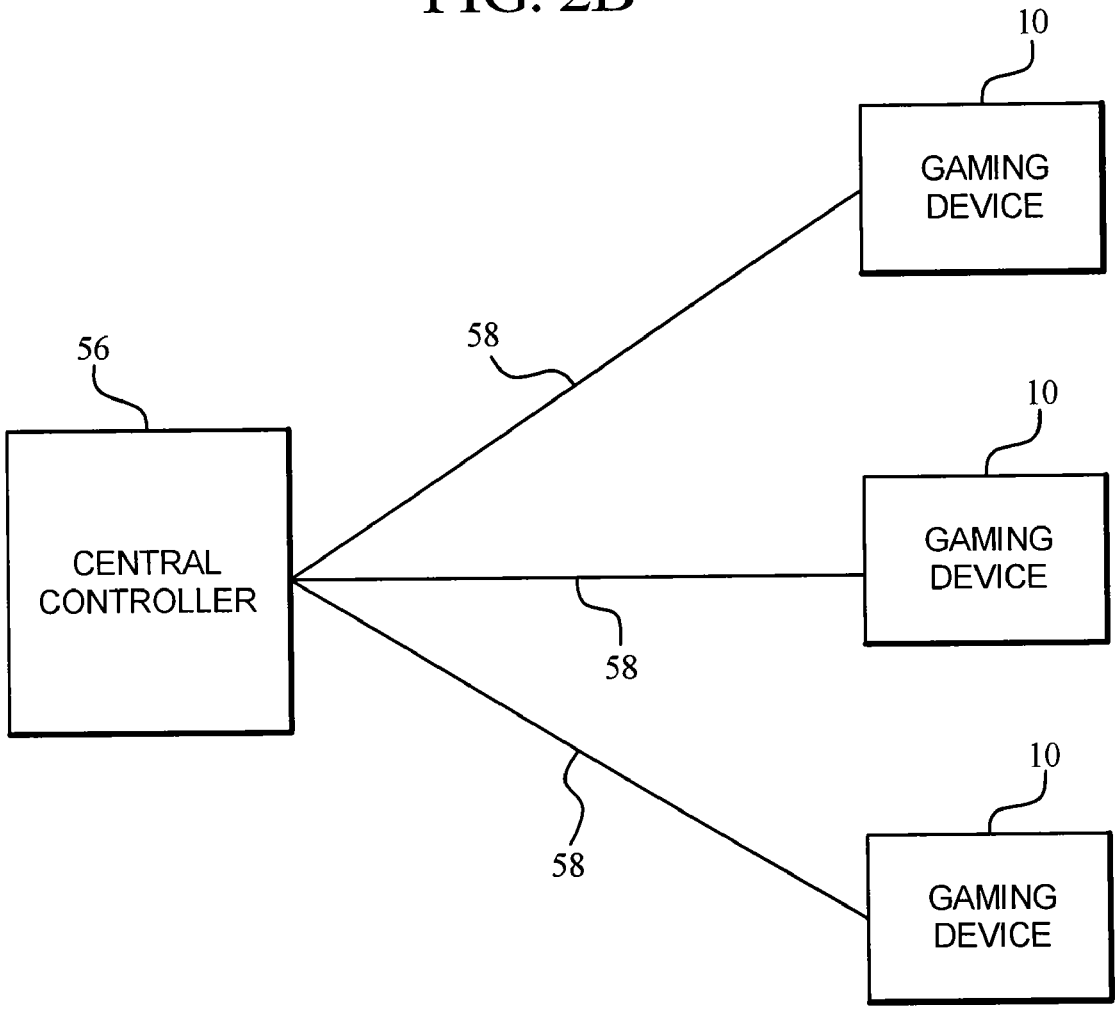
FIG. 2B is a schematic block diagram of one embodiment of a network configuration for a plurality of gaming devices of the present disclosure.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. The terms central server, central controller and remote host are used interchangeably herein. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo or keno game. In this embodiment, each individual gaming device utilizes one or more bingo or keno games to determine the predetermined game outcome value provided to the player for the interactive game played at that gaming device. In one embodiment, the bingo or keno game is displayed to the player. In another embodiment, the bingo or keno game is not displayed to the player, but the results of the bingo or keno game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. In this embodiment, the gaming device and/or player tracking system tracks any players gaming activity at the gaming device. In one such embodiment, the gaming device and/or associated player tracking system timely tracks when a player inserts their playing tracking card to begin a gaming session and also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Virtual Drawing System

Figure 3A:
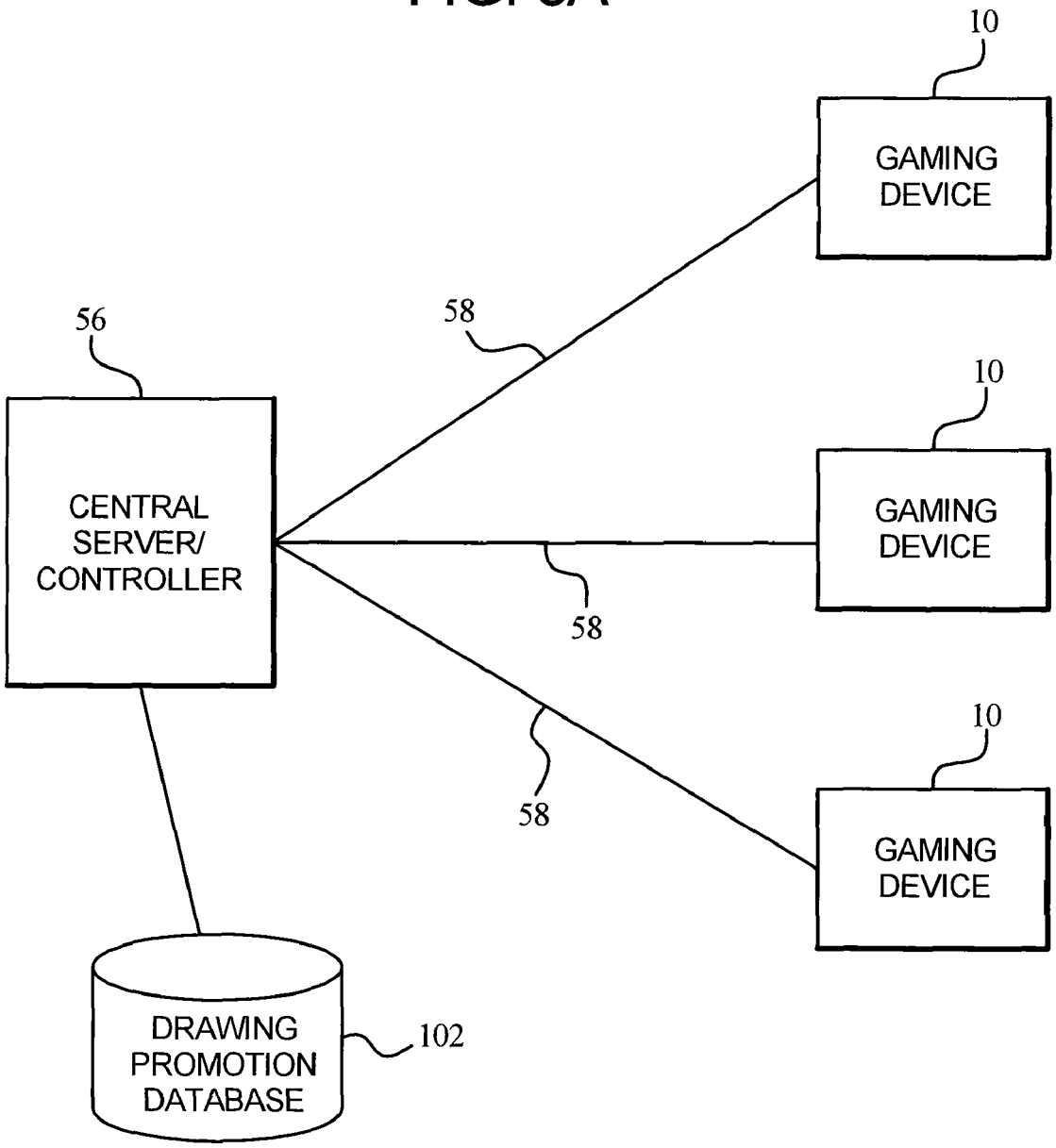
FIG. 3A is a schematic block diagram of one embodiment of a network configuration for a plurality of gaming devices of the present disclosure.

Referring now to FIG. 3A, in one embodiment, the central server or controller maintains the drawing promotion. The central server 56 maintains a drawing promotion database 102 that includes information regarding the drawing prize, drawing period (i.e., the time period during which virtual tickets may be obtained), wager threshold amount, ticket award amount, player drawing accounts associated with drawing account vouchers, and drawing entries. In one embodiment, the drawing promotion database 102 is stored in a memory device of the central server 56. In another embodiment, the drawing promotion database is stored in a memory device of a database server in communication with and accessible by the central server. In one embodiment, the drawing promotion database is separate from the player tracking system. In one embodiment, the gaming system is operable to access the player tracking system to populate player specific data in the data promotion database. In another embodiment, the player tracking system contains the drawing promotion database. In one embodiment, the drawing promotion database is composed of multiple databases distributed on one or more servers. It should be appreciated that the drawing promotion database can be designed using any suitable relational or flat-file database system. It should also be appreciated that the central server is programmed using any suitable programming language to provide the gaming system described herein.

Figure 3B:
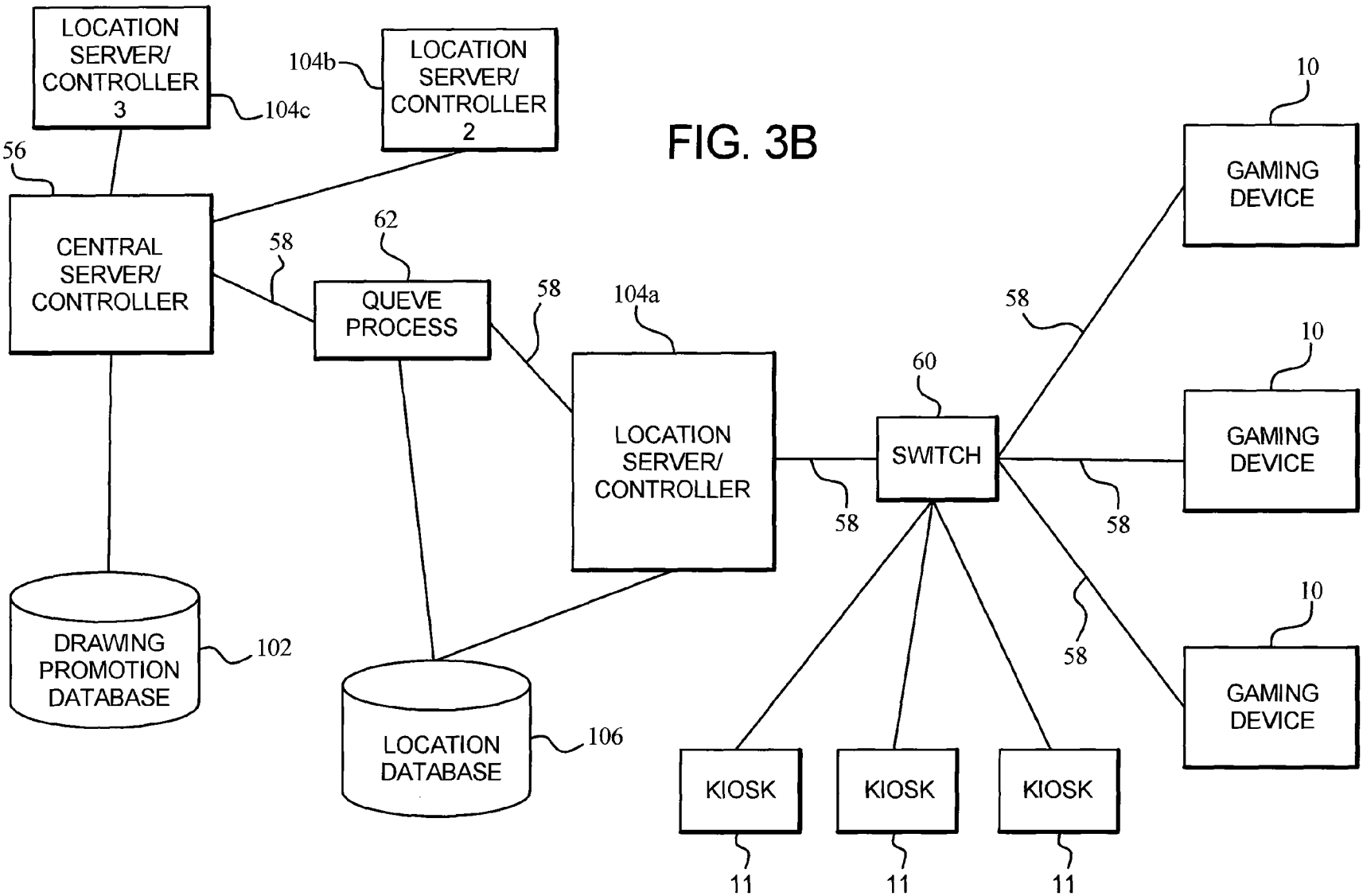
FIG. 3B is a schematic block diagram of one embodiment of a network configuration for a plurality of servers and a plurality of gaming devices of the present disclosure.

Referring to FIG. 3B, a gaming system of the present disclosure is provided with multiple servers or controllers at multiple remote gaming locations. In such an embodiment, some of the functions described herein performed by the central server are performed by the other servers. In one embodiment, the central server or controller 56 is in communication with one or more location servers or controllers (such as configured similar to the central server as described above).

The central server 56 is in communication through a data network or remote communication link 58 with or linked to one or more location servers or controllers 104*a*, 104*b*, and 104*c* at a particular gaming location.

In one embodiment, the central server 56 is connected to a drawing promotion database 102 and the location server 104*a* is connected to a location database 106 (location servers 104*b* and 104*c* are configured similarly to location server 104*a*). In one embodiment, the drawing promotion database and/or the location database includes drawing promotion data regarding drawing account vouchers, drawing accounts, drawing entries, drawing prize, drawing time period, wager threshold amount, and the ticket award amount.

In one embodiment, the central server communicates changes in the drawing promotion data to the location server 104*a* and location database through a queue process 62. That is, a block of data is transmitted on a periodic basis. In one embodiment, the central server is programmed to maintain the queue process. In another embodiment, the location controller is programmed to maintain the queue process. In another embodiment, the data transmission occurs real-time over the data network.

The location server 104*a* is in communication through a data network or remote communication link 58 with or linked to a plurality of gaming machines or gaming devices 10 and/or one or more kiosks 11. In one embodiment, the gaming devices, kiosks, and the location server are connected through a switch 60. A switch is a network device that selects a path or circuit for sending a unit of data to its next destination. In another embodiment, the gaming devices, kiosks, and location server are connected through a router or other networking device.

In one embodiment, the location server or controller is programmed to provide drawing entries or virtual tickets into the player's drawing account associated with the drawing account voucher, based on the player's game play as described in more detail below. In another embodiment, the location server stores data or information regarding player game play, such as player wagers, wherein the data is transmitted to the central server and/or drawing promotion database for providing of the drawing entries. In another embodiment, the gaming device provides drawing entries and transmits data regarding the drawing account, account vouchers, and drawing entries to either the central server or location server. In one embodiment, the transmission of data between the central server, location server, and/or the gaming devices occurs periodically through the queue process 62. In another embodiment, the data transmission occurs real-time over the data network.

Figure 4A:
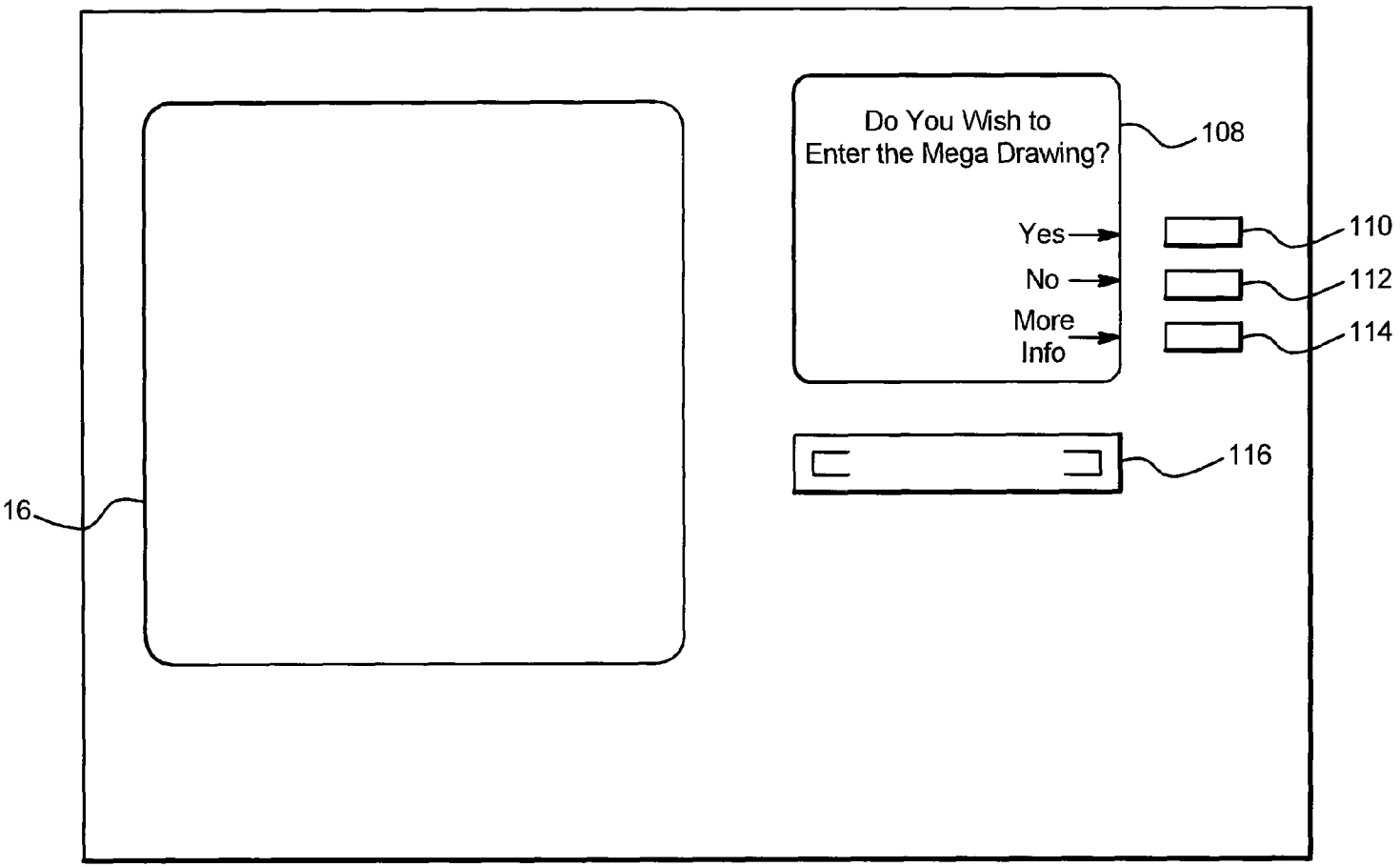
FIGS. 4A-I are screen layouts of one embodiment of the gaming device of the present disclosure.

Referring to FIG. 4A, in one embodiment, upon a player inserting tender (cash or credit voucher) into a gaming device, the gaming device prompts the player on an information panel 108 located adjacent to, or displayed on, the display device 16, as to whether they wish to participate in a drawing promotion. In one embodiment, the players are then given the option of accepting by pressing the "Yes" button 110 or declining the offer by pressing the "No" button 112. The players may also be given the option of finding out more information about the drawing program before making the decision by pressing the "More Info" button 114. In one embodiment, the gaming device prompts the user on an information panel 108 to press a button to read or hear more about the drawing, including the rules and prizes. In one embodiment, if the player does not choose to participate, normal game play will commence. In another embodiment, if the player chooses to participate, a drawing sequence will ensue.

Figure 4B:
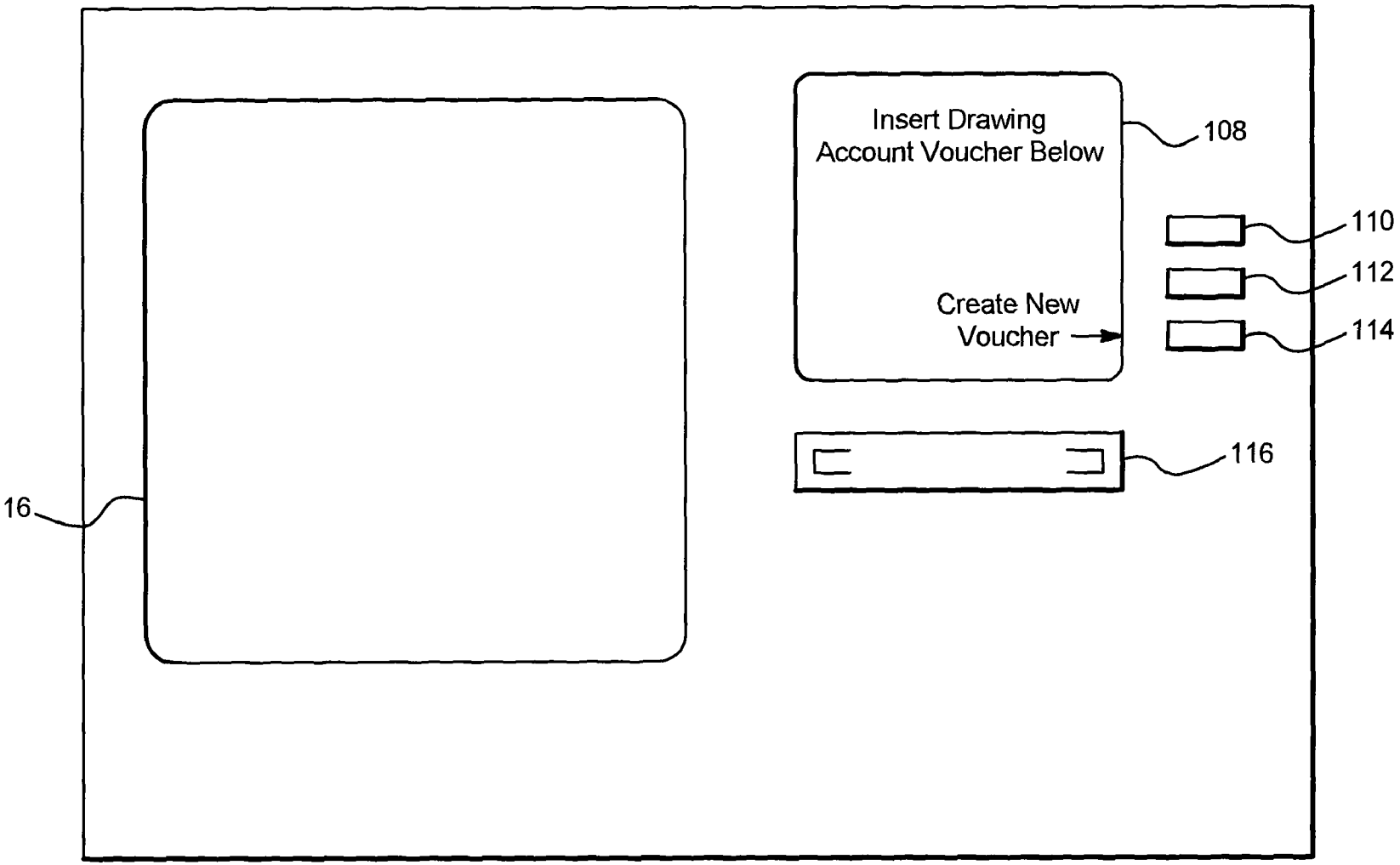

In one embodiment, the drawing sequence includes determining if the player already has a drawing account voucher. Referring to FIG. 4B, in one embodiment, the gaming system prompts the player on the information panel 108 to insert an existing drawing account voucher into the bill acceptor 116 or begin the process to create a new voucher by pressing button 114. Thus, if the player already has a drawing account voucher, they are asked to insert it and are registered to play for virtual tickets or drawing entries. In one example embodiment, the player submits the drawing account voucher at a gaming device causing the location or central server to receive data regarding the drawing account voucher submission and game play. In another embodiment, the voucher is stored electronically and retrieved by the system to register the player for play in the drawing. In one embodiment, if the player requires a new drawing account voucher, a voucher is printed and the player is prompted to insert it into the bill acceptor 116. In another embodiment, the player obtains a drawing account voucher at a customer service desk or kiosk before game play and inserts it into the gaming device. In an embodiment, the account voucher is created electronically and retrieved by the system for game play. In one embodiment, the drawing account voucher is not an actual drawing ticket for the prize. Rather, it is a voucher that creates a virtual drawing account for the player.

In other embodiments, the gaming system provides the player with a drawing account voucher in another suitable manner such as through the mail or over the Internet. In one embodiment, the location controller or central controller causes the drawing account voucher to be provided by selecting the group of players to receive a voucher. In one embodiment, a player is provided with a drawing account voucher based their status in a player tracking system. For example, the gaming system sends an electronic message to the players with a gold or platinum player status level, wherein the electronic message contains a printable drawing account voucher, or a link to a website to download and print a voucher. In another embodiment, the gaming system sends a direct mail drawing account voucher to the player's street address on file in the player tracking system.

Figure 4C:
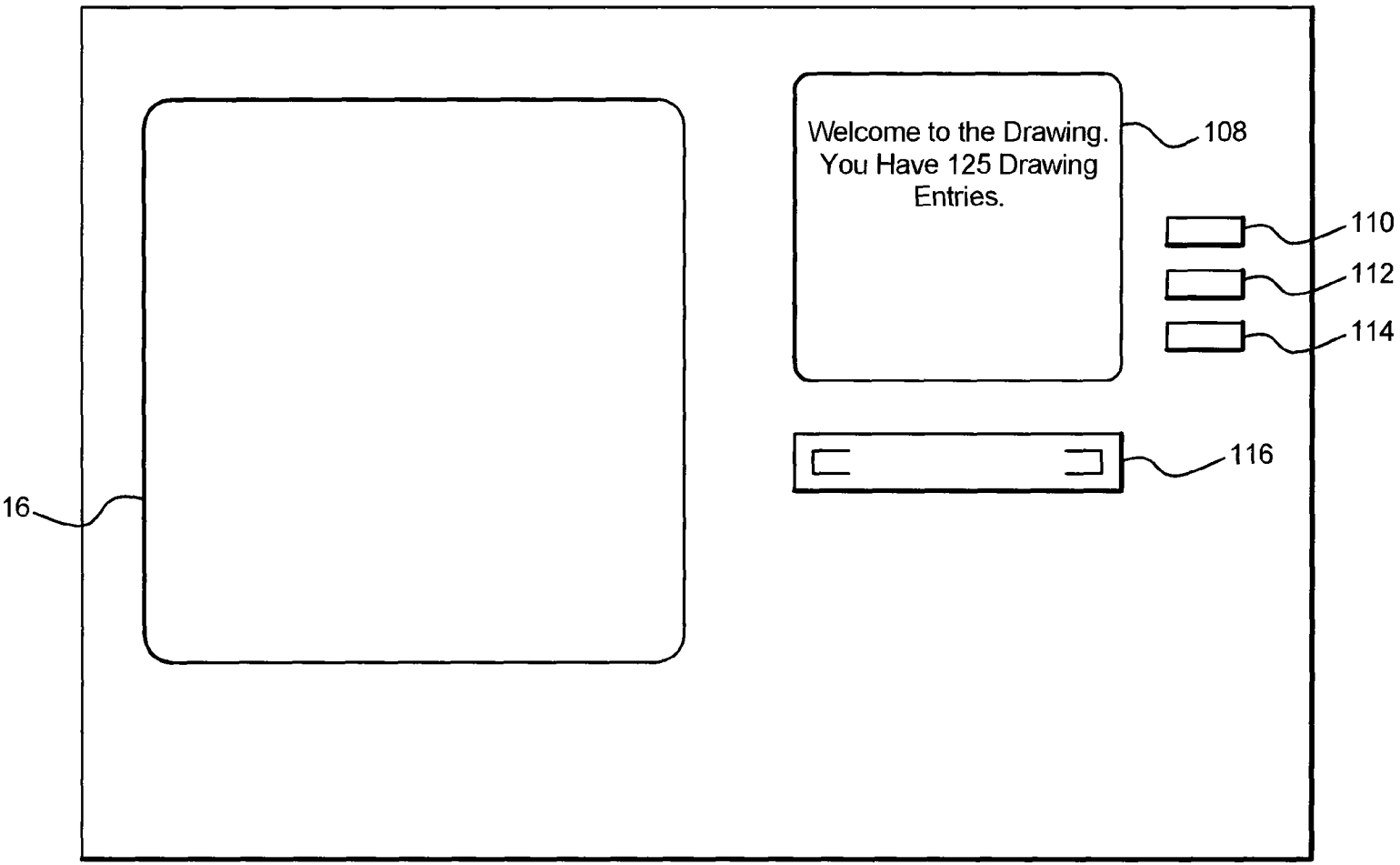

Referring to FIG. 4C, in one embodiment, upon insertion or retrieval of the voucher, an information panel 108 can display pertinent information to the player, such as the current number of virtual tickets the player has accrued, the drawing date, the prize amount, and if applicable, any claim information for a prize the patron has previously won. For example, after insertion of a voucher, the gaming system welcomes the player to the drawing and informs them that they have already accumulated 125 drawing entries, as indicated in information panel 108. In another embodiment, the display of this information is prompted by a set number of tickets issuing to the account or at session end. In one embodiment, the player may input an existing account voucher at a participating kiosk (or website) and enter a PIN to obtain account and drawing information. In one embodiment, if the player scans an account voucher at a kiosk (or website) for a drawing account that contains the winning ticket, the kiosk (or website) displays a message to inform the player how to claim the prize. In one embodiment, to claim the drawing prize, a player must have a valid drawing account voucher and make a claim within a set amount of time. In one embodiment, as discussed below, any claim not made within a certain amount of time will cause the prize to be rolled over into the next drawing.

Figure 4D:
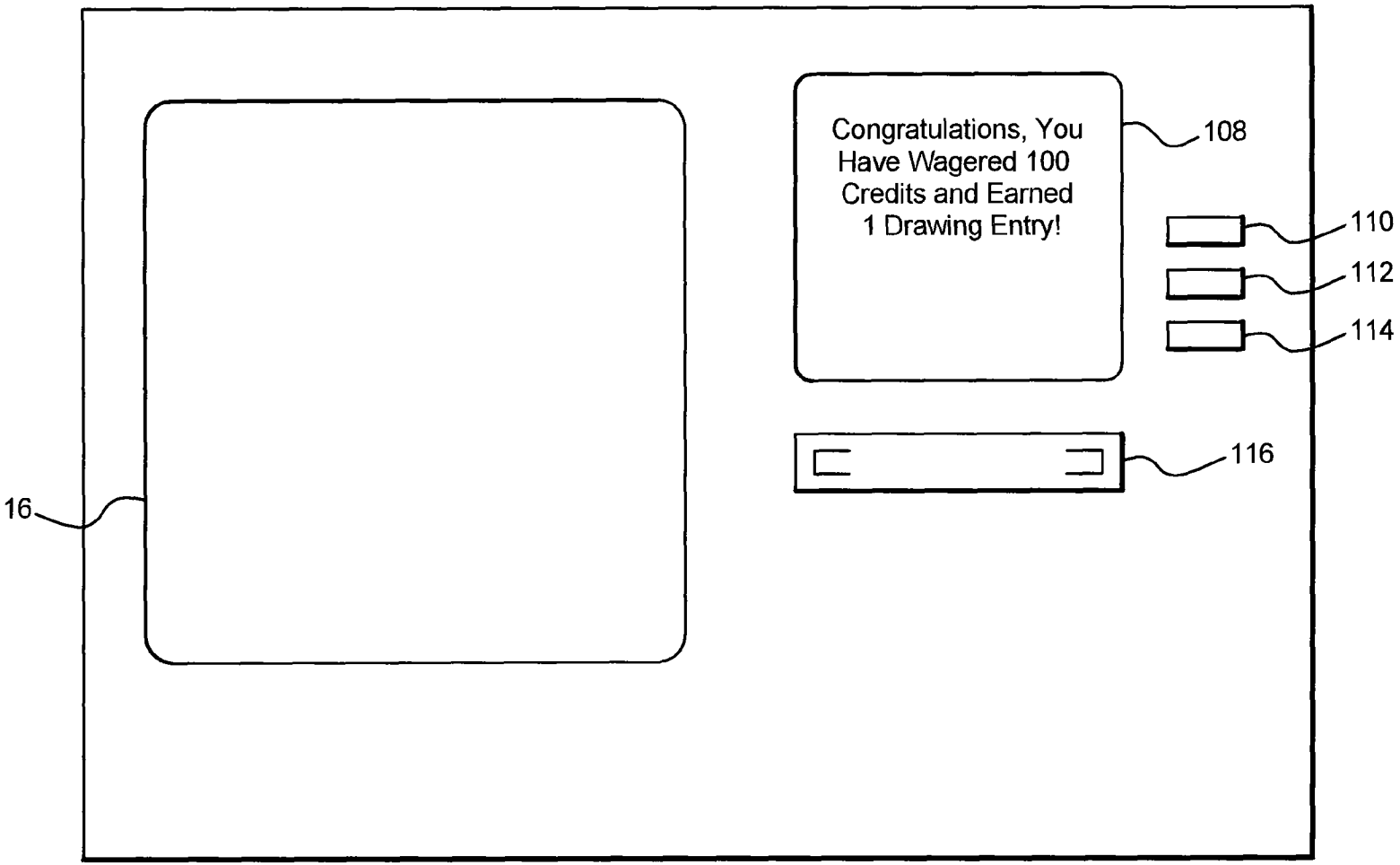

Referring to FIG. 4D, once the player initiates play of the primary game by placing a wager, the gaming system tracks the wager total and awards drawing entries once the player wagers the wager threshold amount. For example, assuming the wager threshold amount was 100 credits, once the player wagers 100 credits, the gaming system informs the player that they "have wagered 100 credits and earned 1 drawing entry" in information panel 108.

Figure 4E:
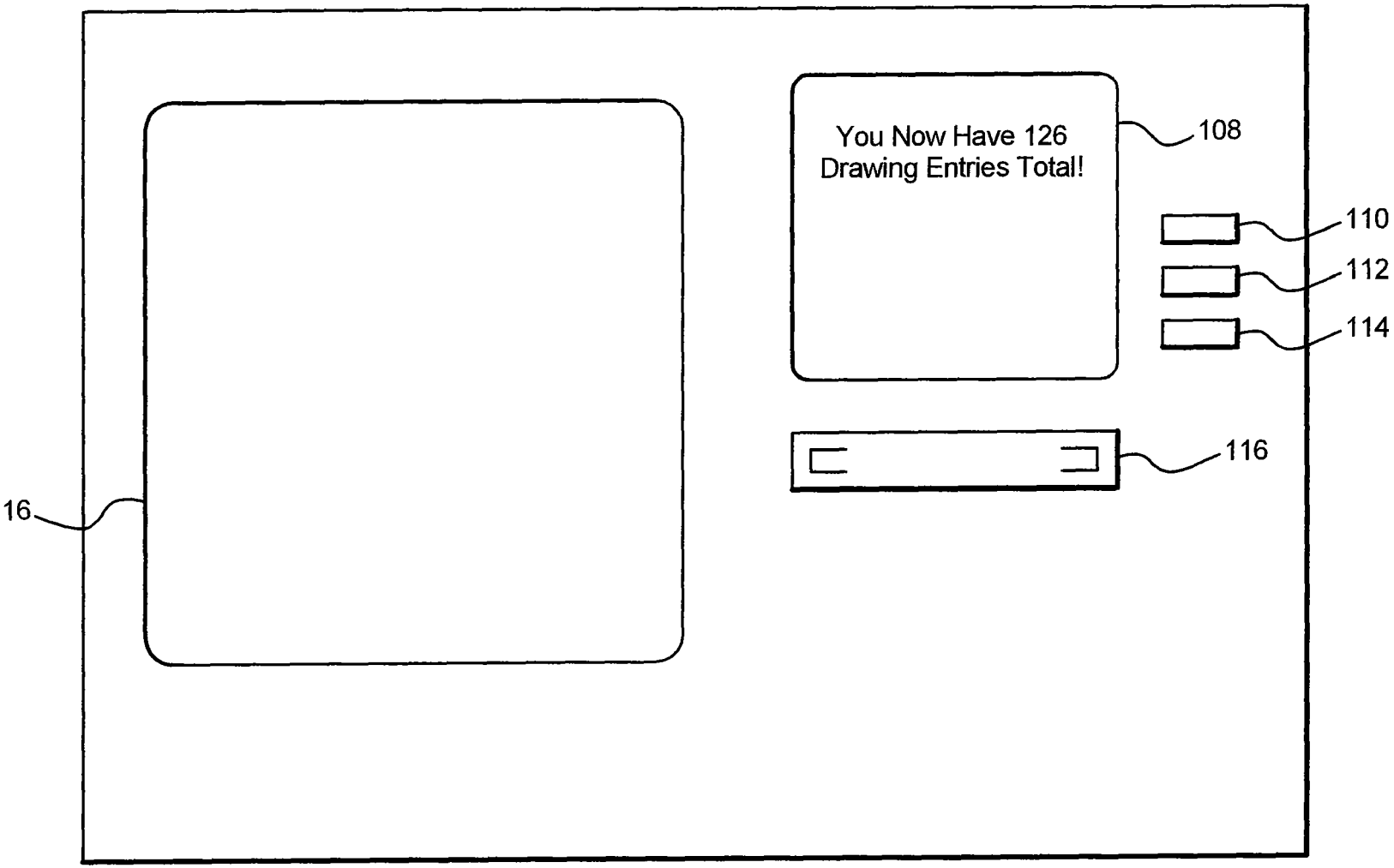
Figure 4F:
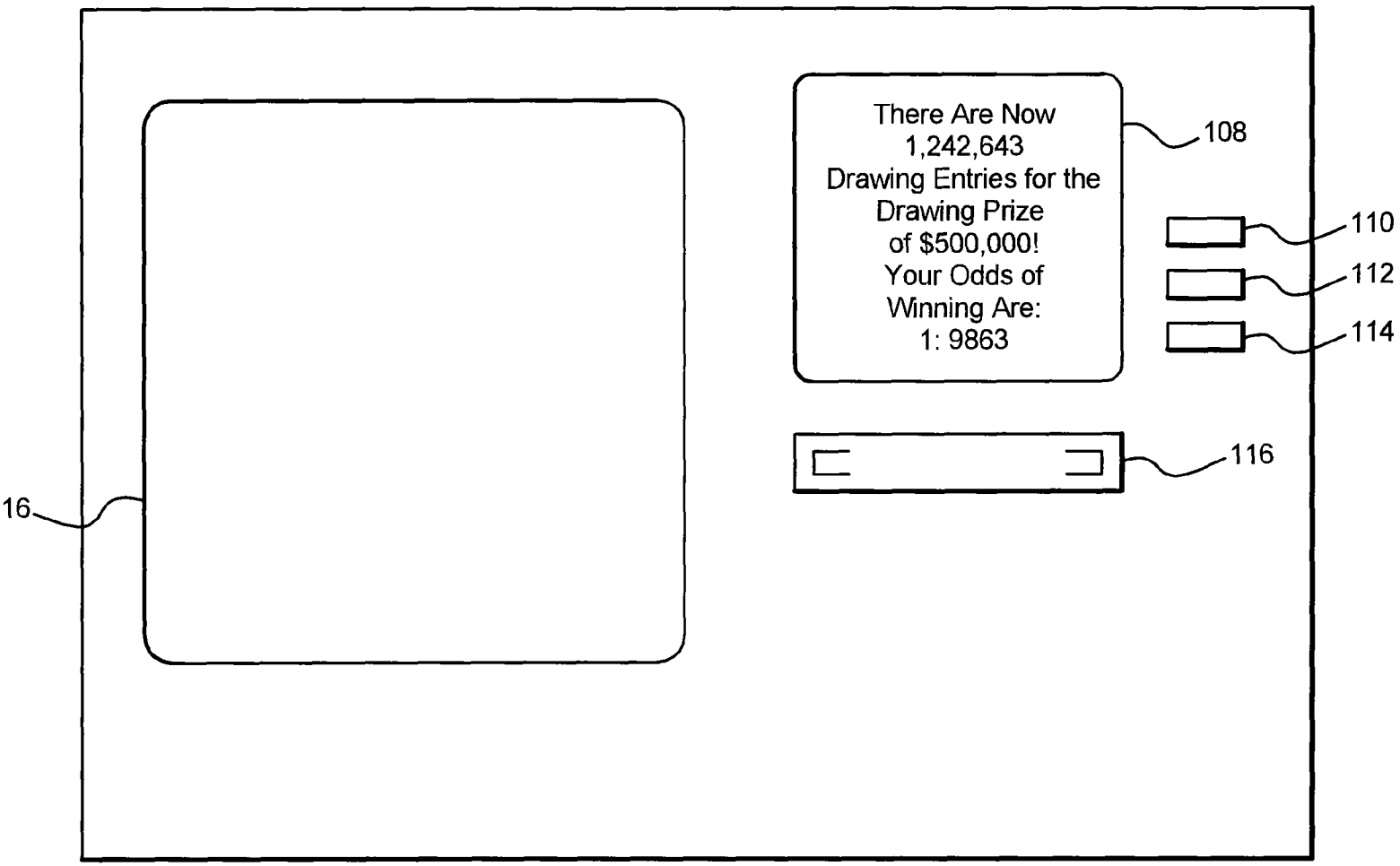

Referring to FIG. 4E, the information panel 108 in one embodiment of the gaming system then notifies the player that they "now have 126 drawing entries total." In one embodiment, the player is prompted whether they want to continue game play. In another embodiment, game play continues automatically after the player is informed of the number of drawing entries they have earned. In one embodiment, referring to FIG. 4F, the information panel 108 notifies the player of the number of total drawing entries for the drawing promotion by all players, and the player's odds of winning the drawing promotion. For example, the information panel 108 displays the message "There are now 1,242,643 drawing entries for the drawing prize of $500,000. Your odds of winning are: 1:9863."

Figure 4G:
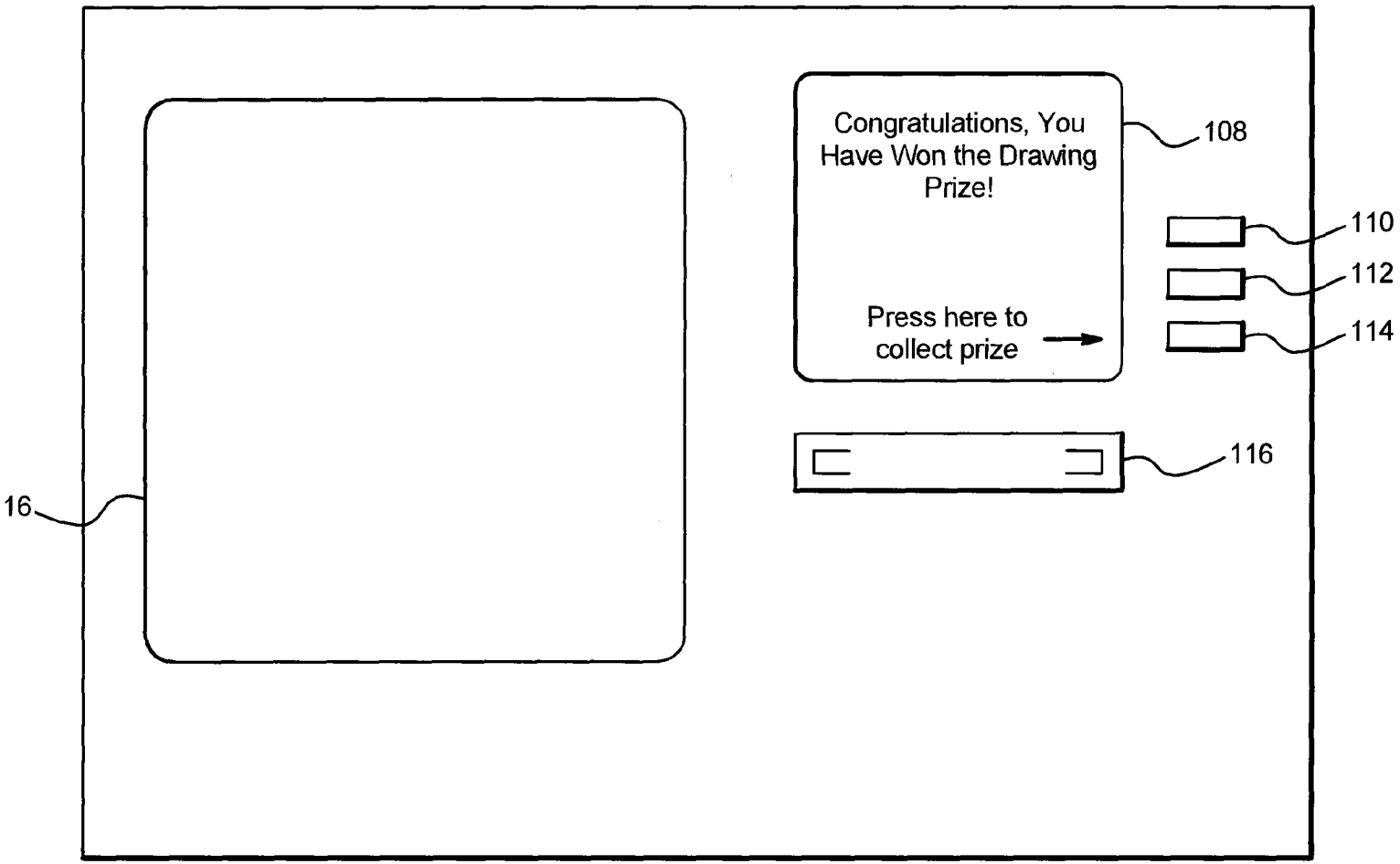

Referring to FIG. 4G, in one embodiment, once the drawing time period ends, the gaming system selects a winning drawing entry, as discussed below, and alerts the player associated with the winning drawing entry. For example, the gaming system notifies the player on the information panel 108 upon insertion of their drawing voucher associated with the drawing account that contained the winning drawing entry that "Congratulations! You have won the drawing prize!" In one embodiment, the gaming system prompts the player to press a button 114 to collect the prize at the gaming device. In one embodiment, the gaming device prints a ticket for the player to redeem at the casino for the drawing prize. In another embodiment, the gaming system provides the drawing prize as credits at the gaming device.

Figure 4H:
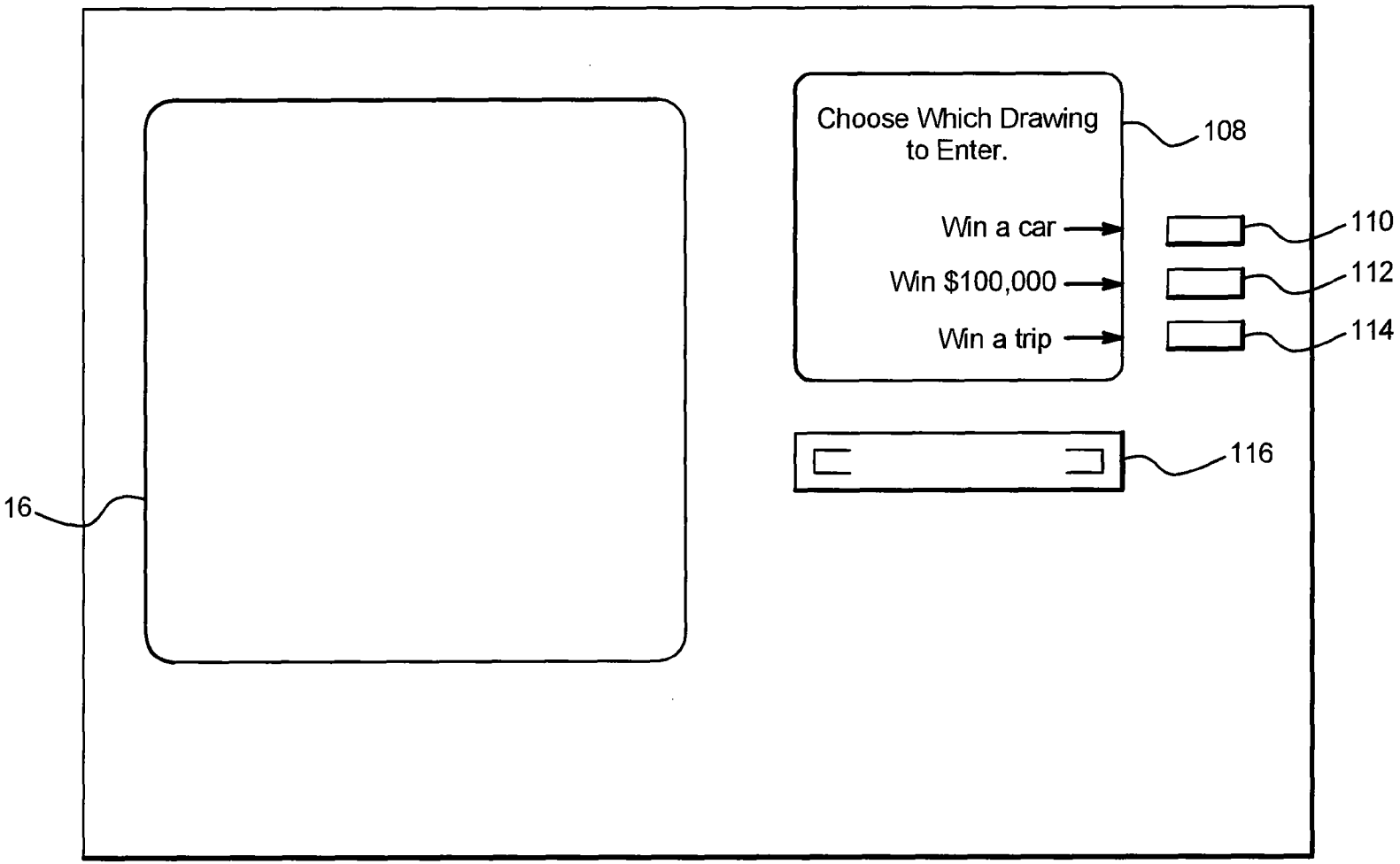
Figure 4I:
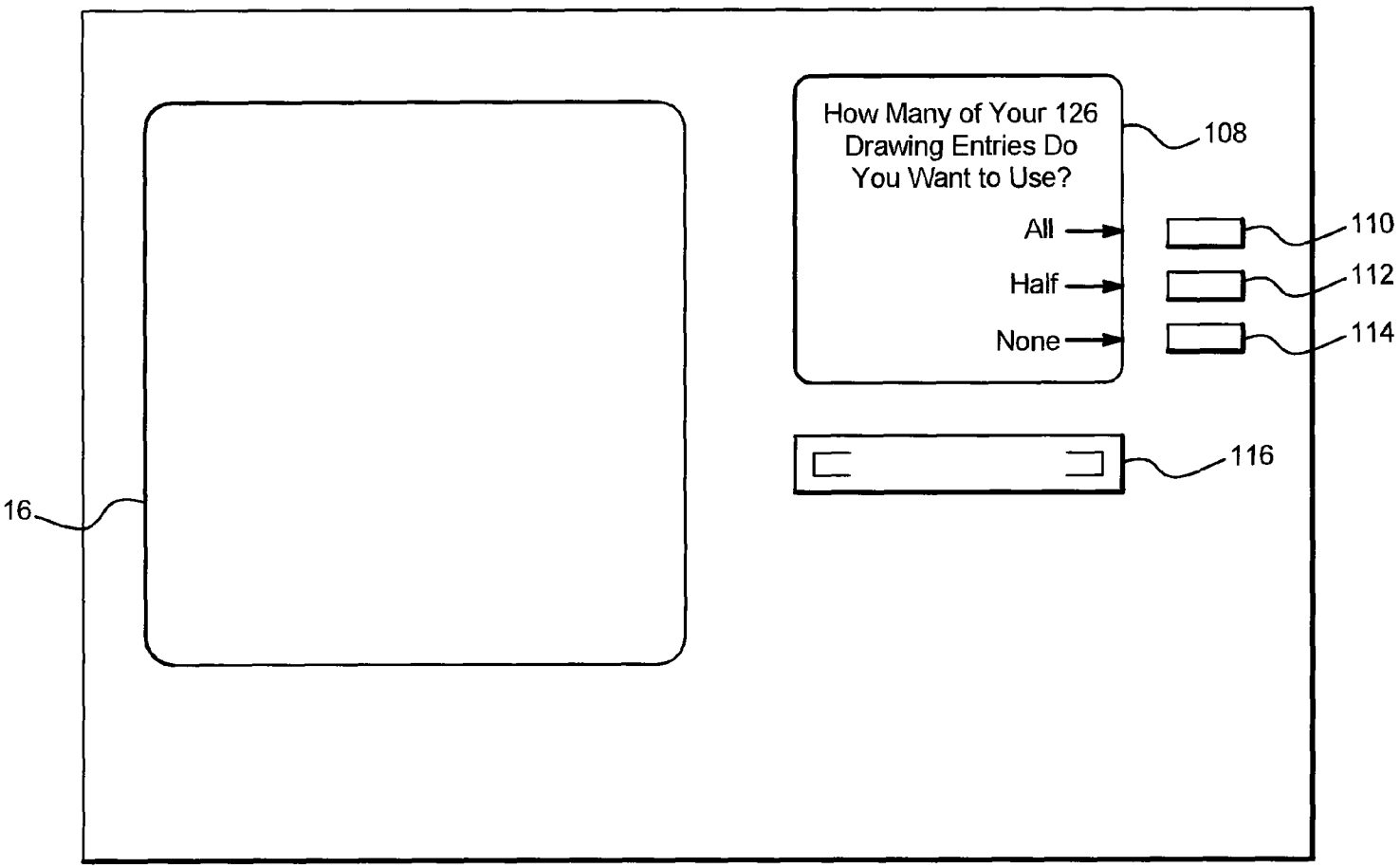

In another embodiment, the drawing account is not associated with a particular drawing promotion. In this embodiment, the player accumulates drawing entries in the drawing account and can select a drawing promotion to apply one or more drawing entries to. In one embodiment, the gaming system provides a player interface for the player to review the available drawing promotions and their available drawing entries, and then apply one or more drawing entries to a selected drawing promotion. In one embodiment, the player interface is on the gaming device. Referring to FIG. 4H, the information panel 108 in one embodiment of the gaming system displays the available drawing promotions and allows the player to select which, if any, drawing promotion to apply the drawing entries to. For example, the gaming device, in communication with the location and/or central controller, prompts the player to "Choose Which Drawing to Enter" on information panel 108 by pressing button 110 corresponding to the "Win a Car" drawing, button 112 for the "Win $100,000" drawing, or button 114 for the "Win a Trip" drawing. Referring to FIG. 4I, the information panel 108 in one embodiment prompts the player to choose how many of their accumulated drawing entries they want to apply to the selected drawing promotion. In one embodiment, the player is prompted whether want to apply "All" of their entries, "Half" of their drawing entries, or "None." In another embodiment, the player interface enables the user to enter a numeric number to indicate the desired number of drawing entries to submit to the desired drawing promotion.

In one embodiment, the gaming system provides a kiosk or customer service location for the player to view drawing promotion information. In another embodiment, the player may view drawing promotion and drawing account information over the Internet and choose to apply one or more accumulated drawing entries in an available drawing promotion. In one embodiment, the drawing entries expire and must be applied or used within a predetermined time period. In another embodiment, the drawing entries do not expire. In one embodiment, the gaming system limits the number of drawing entries a player may accumulate or apply to a particular drawing promotion. In one example embodiment, the gaming system allows only a maximum of 100 drawing entries per drawing promotion per drawing account voucher.

In one embodiment, when the player is prompted for their account voucher they are also prompted for a personal identification number ("PIN"). In another embodiment, to validate the voucher, a HASH function may be used to enhance security. One embodiment of a HASH function is a formula that generates a number from a string of text in such a way that it is extremely unlikely that two strings generate the same number. In one embodiment, the gaming system uses a HASH and PIN to analyze any previous drawing keys to make sure the voucher is legitimate and the account information is secure. In one embodiment, the drawing account voucher contains player identifying information printed on it, such as the player's name or account number, to prevent the redemption of a stolen winning drawing account voucher.

In one embodiment, the drawing account voucher is a paper voucher printed at the gaming device, customer service counter, or at a kiosk. In one embodiment, a ticket printer in the gaming device prints the paper drawing account voucher. In one embodiment, in order for a paper voucher to be used, it must be inserted into the bill acceptor 116. In this embodiment, the machine reads a barcode or similar identifier printed on the voucher. In one embodiment, the paper voucher contains account and security information used to associate and validate it upon insertion. For example, the paper voucher may contain bar codes or a unique alpha-numerical identifier to enhance security. In another embodiment, the drawing account voucher has information regarding the casino or the drawing promotion printed on it.

In another embodiment, the drawing account voucher is a voucher card with either a bar code or magnetic stripe or one that uses RF signals. Such voucher cards can be issued, for example, at a customer service desk, a kiosk, or by the gaming device. In an embodiment, the voucher card must be inserted into a card reader or held near an RF receiver on the gaming device. The voucher card contains either a barcode or a magnetic stripe, or it transmits an RF signal identifying the particular drawing account voucher. From the barcode, magnetic stripe, or RF signal, the gaming system will be able to identify the voucher and associate it with the correct accounts. In another embodiment, the drawing account voucher is a rewritable card. Once the voucher has been read and is properly associated for game play, in one embodiment, game play starts and the voucher is ejected for further use. In another embodiment, the voucher is ejected at session end.

In one embodiment, the drawing account voucher is associated with a player's loyalty program account. In one embodiment, the gaming system enables the player to insert their loyalty program card and drawing account voucher into the gaming device to associate the drawing account voucher with the player's loyalty program account. In one example embodiment, the gaming system is then operable to retrieve the player's available drawing account vouchers that were loaded into the gaming system as described above when the player inserts their player tracking card into a gaming device. In one embodiment, each player may only be allowed to have one active virtual drawing account voucher. In one such embodiment, the gaming device prompts the user whether they want to load the voucher for use in accumulating drawing entries during game play. In another embodiment, the player may have multiple active drawing account vouchers. In this embodiment, the player may be prompted which, if any, drawing account voucher they wish to use for game play. In another embodiment, it is possible to use multiple drawing account vouchers for game play, thus accruing tickets for multiple drawings.

Once the drawing account is created, virtual drawing tickets can be accrued and stored based on the player's coin-in play or wager at the gaming device. The voucher identifies the player as a participant in a drawing and each different drawing has a separate account voucher. Thus, if a player is active in more than one drawing, they will have more than one drawing account voucher, each voucher associated to a drawing account stored on the central server. Each voucher is associated with an account for the player wherein the account can have as many entries for the drawing that the player has qualified for. In an embodiment, the player may have more than one voucher per drawing. If the player chooses not to use an existing voucher at the beginning of their session (e.g., they left it at home), they may generate a new one at this time. This results in the player having more than one voucher for the same drawing.

In another embodiment, drawing account entries are accumulated during table game play, such as poker, blackjack, craps, or roulette. In one embodiment, the player provides the drawing account voucher to a casino employee for registering the player's game play for drawing entry accrual. In another embodiment, the player inserts the drawing account voucher into a drawing account voucher reader located at or near the table game. In one embodiment, a casino employee tracks the total wagers of a player at the table game and enters the total wager into the gaming system through a computer interface. The gaming system then provides the player with a suitable number of drawing entries based on the player's game play.

In one embodiment, the gaming system tracks the amount of credits the player wagered since the insertion or retrieval of a voucher and compares the tracked amount of credits to a wager threshold amount. Each time the player wagers an amount that meets or exceeds the wager threshold amount, the player receives one or more virtual tickets in the drawing as drawing entries in their drawing account. For example, a drawing entry counter in the player's drawing account is incremented each time this wager threshold amount is met. Each time the player meets this wager threshold, more drawing tickets are issued to the same account.

In one embodiment, the wager threshold amount may be a set value, such as 100 credits. That means, that for every 100 credits wagered, the player receives one or more virtual tickets. In one embodiment, the wager threshold amount changes based on the amount of game play. For example, the initial wager threshold amount can be 100 credits to earn 1 virtual drawing ticket. After the player meets the initial threshold amount, the wager threshold amount lowers to 100 credits, then 50 credits. The gaming system can be configured to have multiple progressively lower threshold levels. In another embodiment, the gaming system is configured to have multiple progressively higher threshold levels. In one such embodiment, upon meeting the higher threshold, extra ticket entries may be credited to the players account.

In one embodiment, a single wager must be equal to or exceed the wager threshold amount to earn virtual tickets. In another embodiment, the amount wagered over multiple wagers is accumulated to meet the wager threshold amount. In one embodiment, the gaming system awards a different number of tickets based on the number of wagers required to meet or exceed the wager threshold amount. For example, referring to table 200 in FIG. 5, in one embodiment, the gaming system is configured to award 10 tickets if the player meets the wager threshold amount of 50 credits in 3 or fewer wagers, 5 tickets in 4 to 10 wagers, 2 tickets in 10 to 15 wagers, and 1 ticket for game play that requires 16 or more wagers to meet the wager threshold amount.

In one embodiment, the gaming system is configured that for every wager threshold amount played, the central server provides the player with a plurality of virtual tickets issued to their drawing account. In one embodiment, the player receives a number of virtual tickets equal to a ticket award amount, such as 10 tickets for every 100 credits wagered. The ticket award amount is the number of tickets awarded when the wager threshold amount is met. In another embodiment, the player receives a random number of tickets selected from a predetermined range, such as 1 to 10 tickets. For example, upon wagering the wager threshold amount, the player may be awarded anywhere from 1 to 10 tickets. In one embodiment, the number of tickets selected from the predetermined range depends on the player's status in the player tracking system. That is, higher status players have a greater chance of receiving a higher number of drawing entries or tickets. In another embodiment, the player receives a progressively larger number of tickets for every wager threshold amount wagered.

Referring to table 300 in FIG. 6, in one embodiment, the gaming system is configured such that the player receives 1 virtual ticket for the first wager threshold amount wagered. The player receives 2 tickets for the second wager threshold amount wagered and 3 tickets for the third wager threshold amount wagered. For the fourth through the tenth wager threshold amounts met, the gaming system provides 5 virtual tickets. For the eleventh through the nineteenth wager threshold amounts met, the gaming system provides 10 virtual tickets. Finally, for every subsequent wager threshold amount met, the central server of the gaming system provides twenty-five virtual tickets into the player's drawing account associated with the current drawing account voucher registered in the gaming device.

In one embodiment, the player receives a progressively larger number of tickets for every threshold amount wagered during a predetermined time-period. Thus, the gaming system could be configured to award a progressively larger number of tickets for each threshold attainment during the first hour after the account voucher was loaded into the gaming device. In another embodiment, the clock starts running after the player meets the threshold for the first time. For example, the player receives 1 ticket after meeting the first 100 credit wager threshold amount, and for the next hour (or day, etc.), the number of tickets awarded to the player's drawing account doubles from the previous award.

In another embodiment, the threshold is lowered for each subsequent meeting of the threshold during a predetermined time-period. For example, the wager threshold amount can be configured to reduce in half after every wager of the wager threshold amount for an hour after the account voucher is first loaded, or the initial wager threshold amount is met. In one embodiment, the threshold gets reduced in half until a preset wager threshold floor has been reached, such as 10 credits. In another embodiment, the threshold gets reduced until the player earns 1 ticket for every credit wagered. It should be appreciated that any suitable combination of changing the wager threshold amount and ticket award amount is contemplated by the gaming system of the present disclosure.

In one embodiment, the wager threshold amount may be dynamic based on casino traffic, such as the time of day or week. For example, in one embodiment, in order to attract business at low traffic periods, such as early morning and weekdays, the operator may lower the wager threshold amount. In another embodiment, the operator may raise the ticket award amount during low traffic periods. For example, a player receives 10 drawing tickets when the player wagers the preset wager threshold amount during the morning, but only receives 5 tickets in the evening, which is a higher traffic period. In another embodiment, the gaming system is configured to adjust the wager threshold amount automatically based on the level of current game play in the gaming establishment.

In another embodiment, the wager threshold amount for different players is defined based on each player's status obtained via a player tracking system. As described above, casinos typically have player loyalty programs. Many such programs have multiple player status levels, such as silver, gold, and platinum, depending on frequency and amount of wagering. In one embodiment, a player who is not a member of the loyalty program has to wager a higher wager threshold amount than a loyalty program player before receiving virtual tickets. In one embodiment, lower status level players have to play higher wager thresholds than the higher status level players before receiving a drawing entry in their drawing account. Referring to table 400 in FIG. 7A, in one embodiment, a platinum player has to wager 35 credits before receiving a virtual drawing ticket, a gold player has to wager 50 credits before receiving a virtual drawing ticket, a silver player has to wager 75, and an uncarded player (non-members of the loyalty program) has to wager 100 credits to earn one or more virtual drawing tickets.

In another embodiment, the drawing promotion is restricted based on the player's status in a casino loyalty program. For example, the gaming system provides a drawing promotion for a $1,000,000 prize only to players who are identified as having obtained a gold or platinum player status level. In one embodiment, upon insertion of a player tracking card into the gaming device, the gaming system determines the player status level and prompts the player whether they wish to participate in the $1,000,000 drawing promotion. If the player indicates that they want to participate (by pressing a button), the gaming device prints the player a drawing account voucher for the $1,000,000 drawing promotion.

In another embodiment, the ticket award amount for different players is defined based on each player's status obtained via a player tracking system. In this embodiment, a platinum player receives a higher number of virtual tickets upon wagering the wager threshold amount than a lower status or uncarded player receives upon wagering the same threshold amount. For example, referring to table 402 in FIG. 7B, upon playing the threshold amount, a platinum player receives 7 drawing entries or virtual tickets, the gold player receives 5 virtual tickets, the silver player receives 2 virtual tickets, and the uncarded player receives 1 virtual ticket credited to their drawing account associated with the registered drawing account voucher in use with the gaming device.

In one embodiment, the gaming system disclosed herein includes at least one progressive drawing prize to be provided to a player. In one embodiment, the drawing prize is a dynamic prize that changes based on the amount of tickets issued. In another embodiment, the drawing prize changes based on the amount of coin-in or wagering. In another embodiment, the drawing prize changes based on any combination of the number of virtual tickets issued or coin-in or wagering. In one embodiment, the prize amount for the drawing starts at a base amount and increments based on the number of tickets issued. In one embodiment, the system would track the number of tickets issued and compare the number to a set number. If the set number is met, the progressive is incremented. In an embodiment, the progressive may increment a small percentage for every ticket or in any other chosen manner. In another embodiment, the progressive increase of the prize amount increases whenever a winning ticket is not claimed by rolling the prize amount over to the next drawing. In this manner, the more people who are entered in the drawing, the greater the prize will be. This method also aids in keeping player excitement up as the prize is incrementing based on the number of entries received. Hence, the more exposure the drawing is getting in terms of entries, the higher the prize will be.

Figure 8:
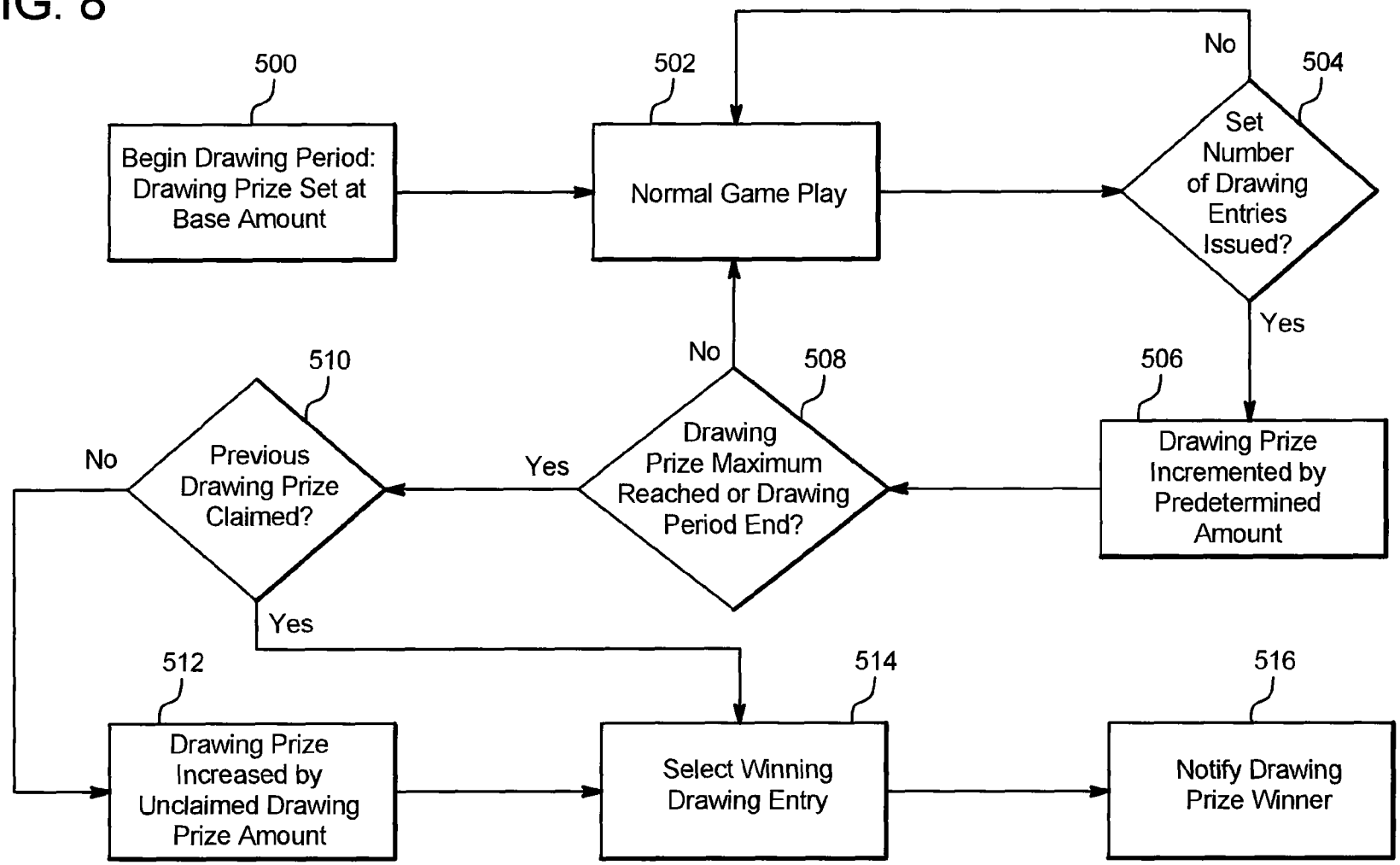
FIG. 8 is a flowchart diagram representing an embodiment of the gaming system of the present disclosure.

Referring to one embodiment of the gaming system in FIG. 8, the base drawing prize amount is set, for example at $250,000, at the beginning of the drawing period, as shown block 500. Normal game play of the gaming devices in the gaming system continues (as shown in block 502) until the gaming system determines that a drawing prize maximum has been reached or it is the end of the drawing period, as shown in block 508. During the drawing period, the gaming system determines if a preset number of virtual tickets or drawing entries, such as 500,000, have issued during normal game play, as shown in block 504. In one embodiment, the gaming system determines periodically, such as once every 24 hours. In another embodiment, the gaming system determines continuously so as to have the drawing prize updated in real-time. In another embodiment, the gaming system only determines at the end of the drawing period if a preset number of drawing entries have issued. After the determination, if a preset number of virtual tickets have not issued, normal game play continues. If a preset number of virtual tickets have issued, the drawing prize amount increases by a predetermined amount, such as $50,000, as indicated in block 506. The gaming system determines if a drawing prize maximum has been reached or if it is the end of the drawing period, as shown in block 508 If not, normal game play 502 continues.

As shown in box 510, once the drawing prize maximum has been reached, or it is the end of the drawing period, the gaming system determines if the previous drawing prize has been claimed by its winner. As indicated in box 512, if the previous drawing prize has not been claimed, the unclaimed drawing prize is rolled over into the current drawing prize. In box 514, the gaming system then selects one or more drawing entries from the total group or pool of drawing entries provided to players for that drawing promotion. In box 516, the gaming system notifies the player associated with the selected drawing entry that they are the drawing promotion winner of a drawing prize. In this example, if the base amount was $250,000, the increment amount was $50,000, the set number of drawing entries was 500,000, and 2,000,000 virtual tickets were issued, the gaming system would increase the drawing prize to $450,000.

Figure 9:
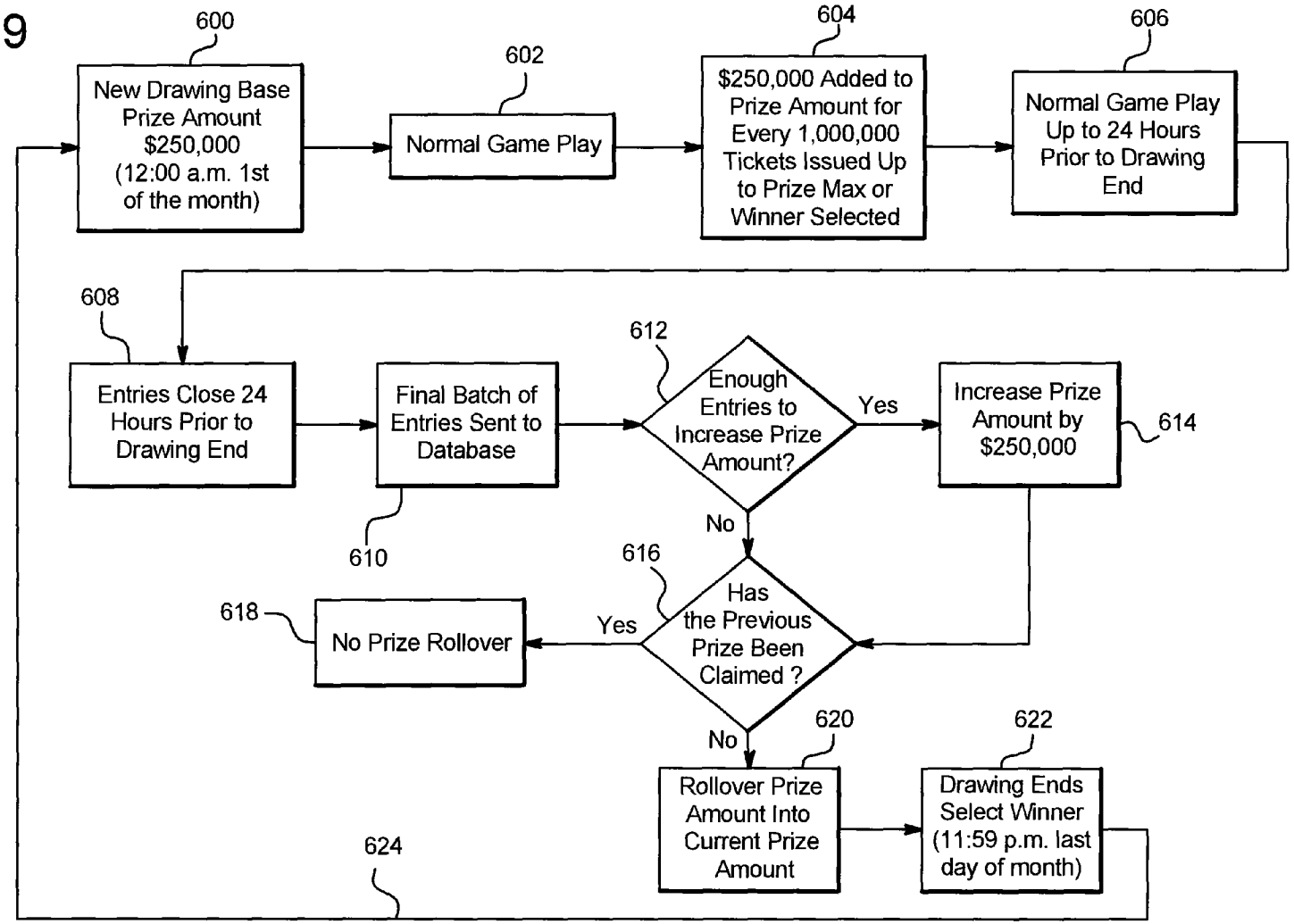
FIG. 9 is a flowchart diagram representing an embodiment of the gaming system of the present disclosure.

Referring to FIG. 9, another embodiment of the gaming system is described. At the beginning of the drawing time period at 12 A.M. on the first day of the month, the drawing prize base amount is set at $250,000, as disclosed in block 600. Normal game play 602 commences throughout the drawing period wherein the gaming system provides players with drawing entries. For every 1,000,000 drawing entries provided, up to a maximum amount or the end of the drawing period, the gaming system increases the drawing prize amount by $250,000, as indicated in block 604. In one embodiment, normal game play 602 continues up to 24 hours before the end of the drawing period, as indicated in block 606. In such an embodiment, the gaming system stops providing drawing entries 24 hours before the end of the drawing period, as disclosed in block 608. In one embodiment, the gaming system then sends all the drawing entries accumulated in the location databases to the central server drawing promotion database, as shown in block 610. The gaming system then checks again to see if there are enough drawing entries accumulated to increase the drawing prize amount since the last, if any, increase, as described in block 612. As discussed above, for every 1,000,000 drawing entries, the gaming system increases the drawing prize by $250,000, as shown in block 614. In one embodiment, the gaming system checks to see if the previous drawing prize has been claimed, as indicated in block 616. As shown in block 618, if the previous drawing prize has been claimed, there is no rollover prize. If the previous drawing prize has not been claimed, the previous drawing prize is rolled over into the current drawing prize amount, as shown in block 620. At the drawing end period, for example at 11:59 P.M. on last day of the month, the gaming system selects the winner of the drawing prize by selecting a drawing entry from the drawing entries accumulated for the drawing during the drawing period, as shown in block 622. In one embodiment, after the winner of the drawing prize is selected, the virtual drawing process starts over and a new drawing promotion is started, as indicated by line 624.

Thus, the gaming system disclosed herein increases player excitement in that even though the odds of winning may decrease with the number of drawing entries or virtual tickets earned, the drawing prize has increased. This feature is preferable to players over a gaming system having a static prize that remains at a low value even though there are many entries, and thus a low chance of winning. This results in a drawing fatigue, as players are not excited about a drawing prize that does not reflect the odds of winning (such as 1:10, 000,000 shot to win a big screen TV). By incorporating this dynamic gaming system, the players are vying for larger awards as the number of drawing entries grows, thus the prize is more in line with the expectation associated with the odds of winning.

In one embodiment, the gaming system includes a display for providing drawing information to players. In one embodiment, the display is a central display located at the casino or gaming location. The central display can be any suitable device, such as television monitors or electronic message boards provided throughout the gaming location. In another embodiment, the display is located on the gaming device. In another embodiment, the display is provided on a kiosk or customer service station, or over the Internet. In one embodiment, the information displayed to the players includes general drawing promotion information, such as the drawing promotion prize, drawing period, number of drawing entries, or a virtual ticket number associated with a winning drawing entry. In another embodiment, the information displayed also includes information pertaining to the drawing account associated with the drawing account voucher, such as the virtual ticket numbers associated with each drawing entry accumulated by the player, the player's odds of winning the drawing promotion, or information regarding past drawing promotions and drawing entries associated with the drawing account.

In one embodiment, drawing entry accrual stops at session end or cash out. In one embodiment, each time a player inserts additional tender, they are again prompted regarding the drawing. In another embodiment, the player is automatically awarded drawing tickets based on wagering as long as the gaming device has the printed voucher, voucher card, or loyalty program card inserted into it.

In one embodiment, the gaming system determines the winner of the drawing entry. In one embodiment, once the drawing time period is set to expire, the winner(s) of the drawing promotion are chosen. In one embodiment, the central server determines a winning drawing entry by selecting one or more drawing entries from a pool of each drawing entry, or virtual ticket, provided to players during game play. As described above, in one embodiment, the drawing entries are credited to specific drawing accounts so the gaming system can easily identify and notify individual players. In another embodiment, the drawing promotion winner(s) are drawn manually.

In one embodiment, the gaming system provides a drawing prize to a player. In one embodiment, the gaming system provides the player with the drawing prize by selecting the winning drawing entry and causes the drawing prize to be given to the player associated with the winning drawing entry. In one embodiment, the winning player must be present at the time of the drawing in order to claim the prize. In one embodiment, if the winner is not present at the time of the drawing or does not claim the drawing prize in a predetermined amount of time, their drawing entries applied to the drawing promotion are credited back to the drawing account for use with another drawing promotion.

In another embodiment, the winning player does not have to be present to claim the drawing prize and the gaming system notifies the player that they have won. In another embodiment, the drawing prize is reduced by a predetermined amount or percentage if the player is not present when the winner is chosen. In one such embodiment, the amount or percentage that the drawing prize is reduced depends on the amount of time that lapses between the time the gaming system selected a drawing promotion winner and the time the player claimed the drawing prize.

In one embodiment, if the player inserts an existing account voucher that contains the winning ticket, the gaming device enters celebration mode to advertise the win and provide the payout. In one embodiment, the celebration mode includes lights, sounds, music, and/or messages displayed on one or more information display screens on or associated with the gaming device. In another embodiment, gaming system provides the winner with the drawing prize by alerting the player in some other manner, such as by kiosk, website, phone call or mailer. In another embodiment, the gaming system provides the ability for the players to check the status of the drawing at a kiosk or customer service location in the gaming location, or over the Internet, to determine whether they won the drawing promotion.

In one embodiment, the gaming system provides the player with their drawing prize at a kiosk or a prize claiming location. In one embodiment, the gaming device prints a drawing prize claim ticket upon insertion of the winning drawing account voucher. In another embodiment, if the player inserts their drawing account voucher into a kiosk or presents it at a prize claiming location, the player is provided with a drawing prize claim ticket or given the drawing prize.

In one embodiment, the gaming system is customizable by the operator. In this embodiment, an administration interface is implemented which is used to configure various drawing parameters, to access reports, and to manage user permissions. For example the operator may configure the drawing promotion, such as the drawing prize amount, drawing period with a start and end data/time, wager threshold amount, and the ticket award amount. In an embodiment, the operator may configure the prize configuration, such as progressive increment amount, progressive prize amount, base prize amount, max prize amount, prize delivery, and claim period. In one embodiment, the gaming system also provides receipts, reports, and user management.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system for providing a drawing promotion comprising:

at least one location controller;

a plurality of gaming devices, each gaming device operable to communicate with the location controller and including a primary game operable upon a wager placed by a player; and a central controller configured to communicate with the location controller and programmed to maintain a drawing promotion, wherein the drawing promotion includes a drawing prize and a plurality of drawing accounts, each drawing account configured to include a number of drawing entries;

said location controller programmed to:

(a) during a drawing period for the drawing promotion:

(i) cause at least one of a plurality of players to be provided with a drawing account voucher associated with one of the drawing accounts;

(ii) thereafter, receive player submission of the drawing account voucher to activate game play for drawing entry accrual for the drawing promotion; and (iii) thereafter, provide at least one of the drawing accounts a quantity of drawing entries which are separate from the drawing account voucher and are to be used for the drawing promotion, wherein the quantity of drawing entries is greater than zero;

(b) transmit data regarding the drawing entries to the central controller;

said central controller is further programmed to:

upon expiration of the drawing period:

(a) select one of the drawing entries from one of the drawing accounts; and (b) cause the drawing prize to be provided to one of the players associated with the selected drawing entry for the drawing prize.

2. The gaming system of claim 1, wherein at least one of the gaming devices is programmed to prompt the player of said gaming device if the player wishes to participate in the drawing promotion.

3. The gaming system of claim 1, which includes a player interface configured to prompt the player to select a desired drawing promotion to apply the drawing entries to and to enable the player to select said desired drawing promotion as the drawing promotion.

4. The gaming system of claim 1, which includes a plurality of location controllers.

5. The gaming system of claim 1, wherein the central controller is programmed to:

(a) determine if a total number of drawing entries exceeds a set number; and (b) if the total number of drawing entries exceeds the set number, increase the drawing prize.

6. The gaming system of claim 1, wherein the central controller is programmed to increase the drawing prize based on an unclaimed drawing prize.

7. The gaming system of claim 1, wherein the central controller is programmed to increase the drawing prize based on wagers placed by one or more players.

8. The gaming system of claim 1, wherein the location controller is programmed to provide the player a designated quantity of drawing entries if the wager placed by the player meets at least a wager threshold amount, wherein the designated quantity of drawing entries is greater than zero.

9. The gaming system of claim 1, wherein the location controller is configured to cause the drawing account voucher to be provided through a delivery mechanism, wherein the delivery mechanism is selected from the group consisting of: a gaming device, a kiosk, the Internet, and postal mail.

10. The gaming system of claim 1, wherein the quantity of provided drawing entries is based on a variable, wherein the variable is selected from the group consisting of: casino traffic, player status in a player tracking system, and wagers placed by one or more players.

11. A gaming system for providing a drawing promotion, said gaming system comprising:

at least one location controller;

a plurality of gaming devices, each gaming device operable to communicate with the location controller and including a primary game operable upon a wager placed by a player; and a central controller configured to communicate with the location controller and programmed to maintain a drawing promotion, wherein the drawing promotion includes a drawing prize and a plurality of drawing accounts, each drawing account configured to include a number of drawing entries;

said location controller programmed to transmit data regarding player wagers to the central controller;

said central controller programmed to:

(a) cause at least one of the players to be provided with a drawing account voucher associated with one of the drawing accounts;

(b) thereafter, receive player submission of the drawing account voucher to activate game play for drawing entry accrual;

(c) thereafter, provide at least one of the drawing accounts a quantity of drawing entries which are separate from the drawing account voucher and are to be used for the drawing promotion, wherein the quantity of drawing entries is greater than zero; and (d) upon expiration of the drawing period:

(i) select one of the drawing entries from one of the drawing accounts; an (ii) cause the drawing prize to be provided to the player associated with the selected drawing entry for the drawing prize.

12. The gaming system of claim 11, wherein at least one of the gaming devices is programmed to prompt the player of said gaming device if the player wishes to participate in the drawing promotion.

13. The gaming system of claim 11, which includes a player interface configured to prompt one of the players to select a desired drawing promotion to apply the drawing entries to and to enable the player to select said desired drawing promotion as the drawing promotion.

14. The gaming system of claim 11, which includes a plurality of location controllers.

15. The gaming system of claim 11, wherein the central controller is programmed to:

(a) determine if a total number of drawing entries exceeds a set number; and (b) if the total number of drawing entries exceeds the set number, increase the drawing prize.

16. The gaming system of claim 11, wherein the central controller is programmed to increase the drawing prize based on an unclaimed drawing prize.

17. The gaming system of claim 11, wherein the central controller is programmed to increase the drawing prize based on wagers placed by one or more of the players.

18. The gaming system of claim 11, wherein the central controller is programmed to provide at least one of the players a quantity of drawing entries if the wager placed by the player meets at least a wager threshold amount, wherein the number of drawing entries is greater than zero.

19. The gaming system of claim 11, wherein the central controller is configured to cause the drawing account voucher to be provided through a delivery mechanism, wherein the delivery mechanism is selected from the group consisting of: a gaming device, a kiosk, the Internet, and postal mail.

20. The gaming system of claim 11, wherein the number of provided drawing entries is based on a variable, wherein the variable is selected from the group consisting of: casino traffic, player status in a player tracking system, and wagers placed by one or more of the players.

21. A method of operating a gaming system to provide a drawing promotion, said gaming system including at least one location controller, a plurality of gaming devices, each gaming device configured to communicate with the location controller and including a primary game operable upon a wager placed by a player, and a central controller configured to communicate with the location controller to maintain the drawing promotion, said method comprising:

(a) maintaining the drawing promotion, wherein the drawing promotion includes a drawing prize, a drawing period, and a plurality of drawing accounts, each drawing account configured to include a number of drawing entries;

(b) providing to at least one of a plurality of players a drawing account voucher associated with one of the drawing accounts;

(c) thereafter, receiving player submission of the drawing account voucher;

(d) thereafter, during the drawing period, providing at least one of the players a quantity of drawing entries based on game play, wherein the drawing entries are separate from the drawing account voucher and are to be used for the drawing promotion, and wherein the quantity of drawing entries is greater than zero; and (e) upon expiration of the drawing period:

(i) selecting one of the drawing entries from one of the drawing accounts; and (ii) providing to the player associated with the selected drawing entry the drawing prize.

22. The method of claim 21, which includes prompting the player which of a plurality of different drawing promotions to apply the drawing entries to.

23. The method of claim 21, which includes determining if a total number of drawing entries exceeds a set number, and, if the total number of drawing entries exceeds the set number, increasing the drawing prize.

24. The method of claim 21, which includes increasing the drawing prize based on an unclaimed drawing prize.

25. The method of claim 21, which includes increasing the drawing prize based on wagers placed by one or more players.

26. The method of claim 21, which includes prompting the player if the player wishes to participate in the drawing promotion.

27. The method of claim 21, which includes providing at least one of the players a designated quantity of drawing entries if the wager placed by the player meets at least a wager threshold amount, wherein the designated quantity of provided drawing entries is greater than zero.

28. The method of claim 21, which includes providing the drawing account voucher through a delivery mechanism, wherein the delivery mechanism is selected from the group consisting of: a gaming device, a kiosk, the Internet, and postal mail.

29. The method of claim 21, wherein the quantity of provided drawing entries is based on a variable, wherein the variable is selected from the group consisting of: casino traffic, player status in a player tracking system, and wagers placed by one or more players.

* * * * *

UNITED STATES PATENT AND TRADEMARK OFFICE

CERTIFICATE OF CORRECTION

PATENT NO. : 7,967,677 B2
APPLICATION NO. : 11/557854
DATED : June 28, 2011
INVENTOR(S) : Anthony J. Baerlocher et al.

It is certified that error appears in the above-identified patent and that said Letters Patent is hereby corrected as shown below:

In Claim 1, column 33, line 33, after "zero;" add --and--.

In Claim 11, column 34, line 31, replace "the players" with --a plurality of players--.

In Claim 11, column 34, line 44, replace "an" with --and--.

Signed and Sealed this
Third Day of July, 2012

David J. Kappos

David J. Kappos
*Director of the United States Patent and Trademark Office*